US011105339B2

(12) United States Patent
Jia et al.

(10) Patent No.: US 11,105,339 B2
(45) Date of Patent: Aug. 31, 2021

(54) PUMP WITH VARIABLE FLOW DIVERTER THAT FORMS VOLUTE

(71) Applicant: Litens Automotive Partnership, Woodbridge (CA)

(72) Inventors: Zhengjie Jia, Woodbridge (CA); John R. Antchak, Aurora (CA)

(73) Assignee: LITENS AUTOMOTIVE PARTNERSHIP, Woodbridge (CA)

( * ) Notice: Subject to any disclaimer, the term of this patent is extended or adjusted under 35 U.S.C. 154(b) by 25 days.

(21) Appl. No.: 16/071,302

(22) PCT Filed: Jan. 23, 2017

(86) PCT No.: PCT/CA2017/050069
§ 371 (c)(1),
(2) Date: Jul. 19, 2018

(87) PCT Pub. No.: WO2017/124198
PCT Pub. Date: Jul. 27, 2017

(65) Prior Publication Data

US 2019/0331131 A1 Oct. 31, 2019

Related U.S. Application Data

(60) Provisional application No. 62/281,728, filed on Jan. 22, 2016, provisional application No. 62/334,715,
(Continued)

(51) Int. Cl.
*F04D 29/46* (2006.01)
*F01P 5/10* (2006.01)
(Continued)

(52) U.S. Cl.
CPC ..... *F04D 29/468* (2013.01); *F01P 5/10* (2013.01); *F01P 7/14* (2013.01); *F04D 15/0022* (2013.01); *F01P 2007/146* (2013.01)

(58) Field of Classification Search
CPC .... F04D 15/0022; F04D 29/46; F04D 29/468; F04D 29/0464; F04D 29/464; F01P 7/14
See application file for complete search history.

(56) References Cited

U.S. PATENT DOCUMENTS 1,274,678 A * 8/1918 Butler ..... F01P 5/10 123/41.47
1,787,653 A * 1/1931 Anderson ..... F04D 29/464 415/148
(Continued)

FOREIGN PATENT DOCUMENTS

AT 5943 U1 1/2003
CN 101334044 12/2008
(Continued)

OTHER PUBLICATIONS

English translation for SU601464 (Year: 1978).*
(Continued)

*Primary Examiner* — David E Sosnowski
*Assistant Examiner* — Wesley Le Fisher
(74) *Attorney, Agent, or Firm* — Millman IP Inc.

(57) ABSTRACT

In an aspect, a pump is provided and includes a pump housing having a pump inlet and a pump outlet. An impeller is rotatably supported in the pump housing for rotation about an impeller axis, and has an impeller inlet configured for drawing in liquid during rotation of the impeller, and an impeller outlet configured for discharging liquid in a generally radial direction. A diverter is pivotally connected in an impeller outlet receiving chamber in the pump housing. The diverter is movable between a first position in which it provides a first restriction to flow out from the pump housing and a second position in which it provides a second restriction to flow out from the pump housing that is greater than the first restriction. In the first position, the diverter forms at
(Continued)

least a portion of a volute around at least a portion of the impeller.

11 Claims, 19 Drawing Sheets

Related U.S. Application Data filed on May 11, 2016, provisional application No. 62/334,730, filed on May 11, 2016, provisional application No. 62/426,283, filed on Nov. 24, 2016.

(51) Int. Cl.
*F01P 7/14* (2006.01)
*F04D 15/00* (2006.01)

(56) References Cited

U.S. PATENT DOCUMENTS

| | | | | |
|---|---|---|---|---|
| 3,443,816 | A | 5/1969 | Saleri | |
| 3,901,623 | A | 8/1975 | Grennan | |
| 4,051,971 | A | 10/1977 | Sated et al. | |
| 4,153,385 | A | 5/1979 | Riefenthaler | |
| 4,177,005 | A | 12/1979 | Bozung et al. | |
| 4,676,065 | A * | 6/1987 | Eberhardt | F01N 3/04 181/261 |
| 4,769,994 | A | 9/1988 | Hirabayashi | |
| 6,755,609 | B2 | 6/2004 | Preinfalk et al. | |
| 6,935,839 | B2 | 8/2005 | Pascoe | |
| 8,585,353 | B2 | 11/2013 | Arnold | |
| 8,590,305 | B2 | 11/2013 | Anschel et al. | |
| 8,984,879 | B2 | 3/2015 | Watson et al. | |
| 2006/0065313 | A1 | 3/2006 | Saleri | |
| 2006/0165523 | A1* | 7/2006 | Rozario | F04D 29/126 415/206 |
| 2012/0114473 | A1* | 5/2012 | Badafem | F04D 29/486 415/203 |
| 2012/0192816 | A1* | 8/2012 | Simon | F16K 3/0281 123/41.44 |
| 2013/0011250 | A1* | 1/2013 | Fournier | F04D 15/0022 415/204 |
| 2013/0110474 | A1 | 5/2013 | Saleri et al. | |
| 2013/0110524 | A1 | 5/2013 | Saleri et al. | |
| 2013/0110563 | A1 | 5/2013 | Saleri et al. | |
| 2013/0110571 | A1 | 5/2013 | Saleri et al. | |
| 2015/0016966 | A1* | 1/2015 | Fournier | F04D 15/0005 415/148 |
| 2015/0337715 | A1* | 11/2015 | Fournier | F04D 15/0022 415/150 |
| 2016/0273492 | A1 | 9/2016 | Saleri | |
| 2016/0281859 | A1 | 9/2016 | Saleri | |

FOREIGN PATENT DOCUMENTS

| | | | | |
|---|---|---|---|---|
| CN | 101334044 | A | 12/2008 | |
| CN | 101334044 | A * | 12/2008 | |
| DE | 1946554 | U | 9/1966 | |
| DE | 1550441 | A1 | 1/1970 | |
| DE | 2039129 | A1 | 2/1971 | |
| DE | 7136850 | | 12/1971 | |
| DE | 7534781 | U | 2/1976 | |
| DE | 3831687 | A1 | 3/1990 | |
| DE | 4200507 | A1 | 7/1993 | |
| DE | 10108537 | A1 | 5/2002 | |
| DE | 20316535 | U1 | 2/2004 | |
| DE | 212009000182 | U1 | 6/2012 | |
| DE | 112011101949 | T5 | 3/2013 | |
| DE | 102012019715 | A1 | 5/2013 | |
| DE | 202013008315 | U1 | 2/2014 | |
| DE | 202011110766 | U1 | 5/2016 | |
| DE | 202011110767 | U1 | 5/2016 | |
| DE | 202013012344 | U1 | 7/2016 | |
| DE | 112014005306 | T5 | 8/2016 | |
| EP | 333191 | A2 | 9/1989 | |
| EP | 2536928 | A1 | 8/2011 | |
| FR | 430072 | A | 10/1911 | |
| FR | 15220 | E | 5/1912 | |
| FR | 1482483 | A | 5/1967 | |
| FR | 2031155 | A5 | 11/1970 | |
| FR | 2057809 | A5 | 5/1971 | |
| FR | 2113044 | A5 | 6/1972 | |
| FR | 2320030 | A7 | 2/1977 | |
| FR | 2330934 | A1 | 6/1977 | |
| FR | 2828547 | A3 | 2/2003 | |
| FR | 2995946 | A3 | 3/2014 | |
| GB | 191113602 | A | 11/1911 | |
| GB | 1139200 | A | 1/1969 | |
| GB | 1280371 | A | 7/1972 | |
| IT | 1033739 | B | 7/1975 | |
| IT | 1050824 | B | 9/1975 | |
| IT | 1053054 | B | 10/1975 | |
| IT | 1053107 | B | 11/1975 | |
| IT | 1066898 | B | 7/1976 | |
| IT | 1066899 | B | 7/1976 | |
| IT | 1082002 | B | 3/1977 | |
| IT | 1082026 | B | 5/1977 | |
| IT | 1082027 | B | 5/1977 | |
| IT | 1081168 | B | 7/1977 | |
| IT | 1096830 | B | 6/1978 | |
| IT | 1165088 | B | 6/1979 | |
| IT | 1136023 | B | 10/1980 | |
| SU | 601464 | A1 | 4/1978 | |
| SU | 601464 | A1 * | 4/1978 | F04D 29/468 |

OTHER PUBLICATIONS

English Translation for CN101334044A (Year: 2008).*
Extended European Search Report dated Jul. 23, 2019 in connection with corresponding EP application No. EP118770.
International Search Report dated Mar. 21, 2017 in connection with corresponding PCT application No. PCT/CA2017/050069.
International Written Opinion dated Jan. 25, 2018 in connection with corresponding PCT application No. PCT/CA2017/050069.
International preliminary report on patentability dated Apr. 17, 2018 in connection with corresponding PCT application No. PCT/CA2017/050069.
English translation of Japanese patent application No. JP48104103 which was identified on the Information Disclosure Statement filed Jan. 21, 2019.
Chinese Office Action for CN201780007798.4 dated Oct. 24, 2019.
Office Action for CN201780007798.4 dated Sep. 30, 2020.

* cited by examiner

BRUSHED DC MOTOR

BRUSHED DC MOTOR

PUMP WITH VARIABLE FLOW DIVERTER THAT FORMS VOLUTE

CROSS-REFERENCE TO RELATED APPLICATIONS

This application claims the benefit of U.S. Provisional Patent Application No. 62/281,728 filed Jan. 22, 2016, U.S. Provisional Patent Application No. 62/334,715 filed May 11, 2016, U.S. Provisional Patent Application No. 62/334,730 filed May 11, 2016, and U.S. Provisional Patent Application No. 62/426,283 filed Nov. 24, 2016, the contents of all of which are incorporated herein in their entirety.

FIELD

This disclosure relates to fluid pumps and more particularly to water pumps for stationary or vehicular engines wherein the water pump is driven in direct proportion to the speed of the engine.

BACKGROUND

It is known to provide water pumps on stationary or vehicular engines in order to circulate coolant through the engine in order to prevent the engine from overheating. In many applications, the water pump is driven by a belt or the like that is itself driven by a crankshaft of the engine. As a result, the speed of the water pump is determined by the speed of the engine. The coolant flow of the water pump is generally selected so that in the worst case combination of engine speed and cooling needs, the engine will be sufficiently cooled by the coolant flow from the water pump. However, inherent in such a design practice is that that water pump is pumping more coolant than necessary in some situations.

It would be advantageous to be able to provide a water pump or a pump in general that had some means of reducing coolant flow when it is not needed. Pumps are known that employ valves for selectively cutting off flow, however such devices typically negatively affect the efficiency of the pump. Other pumps are known that are capable of speed control as a means for controlling flow, however, typically such pumps operate for significant periods of time outside of a range in which their design is optimized for efficiency.

SUMMARY

In an aspect, there is provided a pump having a pump housing having a pump inlet and a pump outlet and an impeller. The impeller is rotatably supported in the pump housing for rotation about an impeller axis, and has an impeller inlet configured for drawing in liquid from the pump inlet during rotation of the impeller, and an impeller outlet configured for discharging liquid in a generally radial direction. The pump housing has an impeller outlet receiving chamber positioned radially outside the impeller for transport of liquid from the impeller outlet to the pump outlet. The pump housing further includes a diverter. The diverter has an upstream end that is pivotally connected at a first location in the impeller outlet receiving chamber and a downstream end at a second location in the impeller outlet receiving chamber. The diverter is pivotable between a first position in which the diverter provides a first restriction to flow out from the pump housing, and in which the diverter forms at least a portion of a volute around at least a portion of the impeller. The volute has a cross-sectional area that increases progressively from the upstream end of the diverter to the downstream end of the diverter, and a second position in which the diverter provides a second restriction to flow out from the pump outlet that is greater than the first restriction.

In another aspect, there is provided a method of operating a pump that has a pump housing having a pump inlet and a pump outlet and that has an impeller rotatably supported in the pump housing for rotation about an impeller axis. The impeller has an impeller inlet configured for drawing in liquid from the pump inlet during rotation of the impeller, and an impeller outlet configured for discharging liquid in a generally radial direction. The pump housing has an impeller outlet receiving chamber positioned radially outside the impeller for transport of liquid from the impeller outlet to the pump outlet. The method includes:

a) providing a diverter that is part of the pump housing, wherein the diverter has an upstream end that is pivotally connected at a first location in the impeller outlet receiving chamber and a downstream end that is at a second location in the impeller outlet receiving chamber;

b) positioning the diverter in a first position in which the diverter provides a first restriction to flow out from the pump housing, and in which the diverter forms at least a portion of a volute around at least a portion of the impeller, wherein the volute has a cross-sectional area that increases progressively from the upstream end of the diverter to the downstream end of the diverter, c) rotating the impeller while the diverter is in the first position to drive flow through the pump outlet; and d) positioning the diverter in a second position in which the diverter provides a second restriction to flow out from the pump outlet that is greater than the first restriction.

In another aspect, there is provided a pump including a pump housing having a pump inlet and a pump outlet and an impeller. The impeller is rotatably supported in the pump housing for rotation about an impeller axis, and has an impeller inlet configured for drawing in liquid from the pump inlet during rotation of the impeller, and an impeller outlet configured for discharging liquid in a generally radial direction. The pump housing has an impeller outlet receiving chamber positioned radially outside the impeller for transport of liquid from the impeller outlet to the pump outlet. The pump housing further includes a diverter that has an upstream end that is pivotally connected at a first location in the impeller outlet receiving chamber and a downstream end at a second location in the impeller outlet receiving chamber. The diverter is pivotable between a first position in which the diverter provides a first restriction to flow out from the pump housing, and in which the diverter forms at least a portion of the impeller outlet receiving chamber having a cross-sectional area that increases progressively from the upstream end of the diverter to the downstream end of the diverter, and a second position in which the diverter provides a second restriction to flow out from the pump outlet that is greater than the first restriction. In the first position, the diverter is substantially flush with a portion of the pump housing immediately upstream from the diverter.

In yet another aspect, there is provided a pump including a pump housing and an impeller. The pump housing has a pump inlet and a pump outlet. The impeller is rotatably supported in the pump housing for rotation about an impeller axis, and has an impeller inlet configured for drawing in liquid during rotation of the impeller, and an impeller outlet configured for discharging liquid in a generally radial direction. A diverter is pivotally connected in an impeller outlet receiving chamber in the pump housing. The diverter is movable between a first position in which the diverter provides a first restriction to flow out from the pump housing and a second position in which the diverter provides a second restriction to flow out from the pump housing that is greater than the first restriction. In the first position, the diverter forms at least a portion of a volute around at least a portion of the impeller.

In yet another aspect, there is provided a pump for pumping liquid through a vehicular cooling system. The pump includes a pump housing and an impeller. The pump housing has a pump inlet, a first pump outlet fluidically connected to a first cooling load and a second pump outlet fluidically connected to a second cooling load. The impeller is rotatably supported in the pump housing, and has an axially oriented impeller inlet configured for drawing in liquid generally axially from the pump inlet during rotation of the impeller, and a radially oriented impeller outlet configured for discharging liquid generally radially from the impeller towards the first and second pump outlets. A first cooling load diverter is connected to the pump housing and a second cooling load diverter connected to the pump housing. The first cooling load diverter is movable between a first position for the first cooling load diverter in which the first cooling load diverter provides a first flow restriction to flow out from the first pump outlet and a second position for the first cooling load diverter in which the first cooling load diverter provides a second flow restriction to flow out from the first pump outlet that is greater than the first flow restriction to flow out from the first pump outlet. The second cooling load diverter is movable between a first position for the second cooling load diverter in which the second cooling load diverter provides a first flow restriction to flow out from the second pump outlet, and a second position for the second cooling load diverter in which the second cooling load diverter provides a second flow restriction to flow out from the second pump outlet that is greater than the first flow restriction to flow out from the second pump outlet. When the first cooling load diverter is in the first position for the first cooling load diverter the first cooling load diverter forms at least a portion of a first volute around a portion of the impeller. When the second cooling load diverter is in the first position for the second cooling load diverter, the second cooling load diverter forms at least a portion of a second volute around a portion of the impeller.

In another aspect, there is provided a method of operating a pump that has a pump housing having a pump inlet, a first pump outlet connected to a first cooling load and a second pump outlet connected to a second cooling load and that has an impeller rotatably supported in the pump housing for rotation about an impeller axis. The impeller has an impeller inlet configured for drawing in liquid from the pump inlet during rotation of the impeller, and an impeller outlet configured for discharging liquid in a generally radial direction. The pump housing has a first impeller outlet receiving chamber for transport of liquid from the impeller to the first pump outlet and a second impeller outlet receiving chamber for transport of liquid from the impeller to the second pump outlet. The method includes:

a) positioning a first cooling load diverter in the pump housing in a first position for the first cooling load diverter in the first impeller outlet receiving chamber, wherein in the first position the diverter forms at least part of a first volute around a first portion of the impeller;

b) positioning a second cooling load diverter in the pump housing in a first position for the second cooling load diverter in the second impeller outlet receiving chamber, wherein in the first position for the second cooling load diverter the second cooling load diverter forms at least part of a second volute around a second portion of the impeller;

c) rotating the impeller at a selected speed after steps a) and b) to cause a first flow rate through the first pump outlet and a first flow rate through the second pump outlet; and d) positioning the first cooling load diverter in a second position for the first cooling load diverter while maintaining the impeller at the selected speed and while maintaining the second cooling load diverter in the first position, and thereby causing a second flow rate through the first pump outlet that is smaller than the first engine block flow rate, while substantially maintaining the first flow rate through the second pump outlet.

BRIEF DESCRIPTION OF THE DRAWINGS

The foregoing and other aspects will now be described by way of example only with reference to the attached drawings, in which.

DETAILED DESCRIPTION OF EXAMPLE EMBODIMENTS

Figure 1:
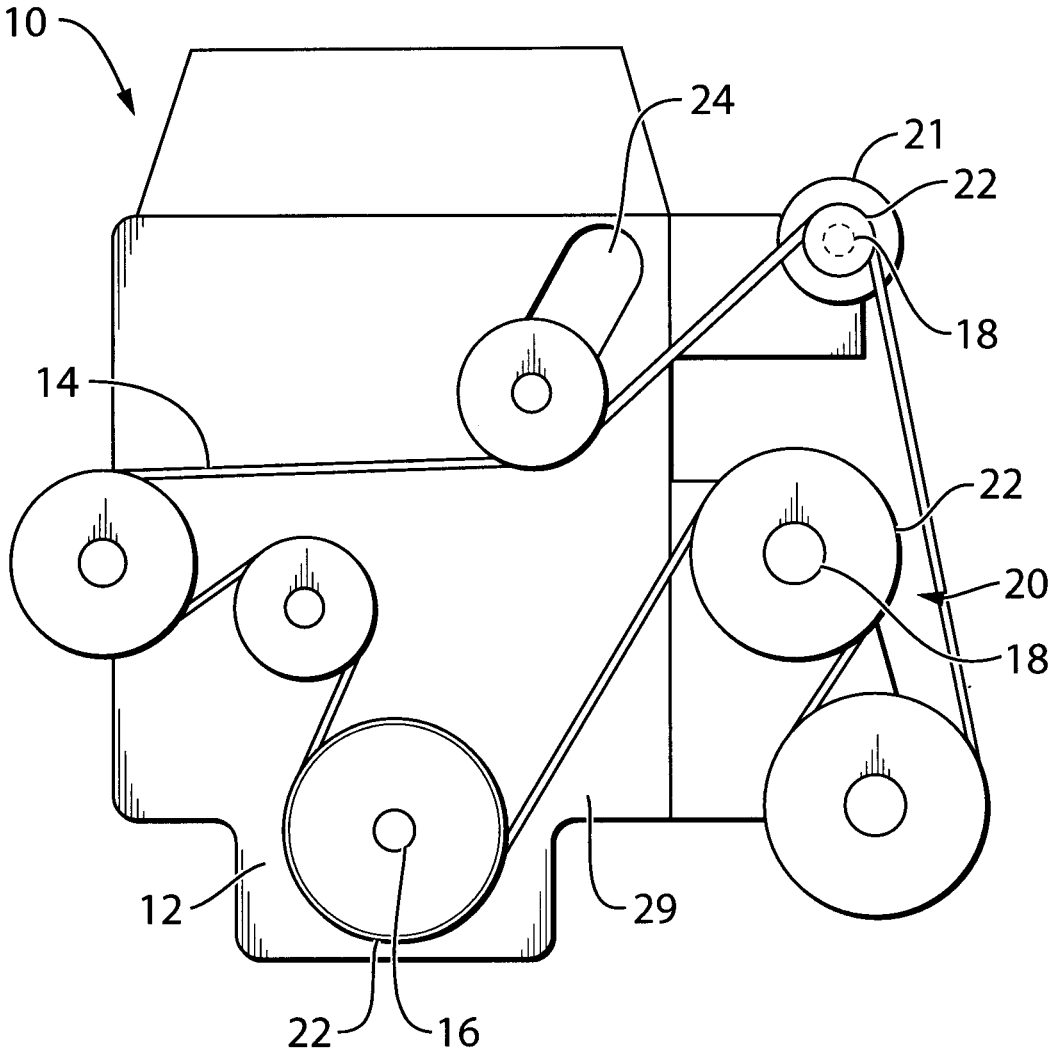
FIG. 1 is an elevation view of an engine with an endless drive arrangement for driving a pump for pumping a liquid (e.g. coolant) according to an example embodiment of the present disclosure.

Reference is made to FIG. 1 which shows an endless drive arrangement 10 for an engine 12 for a vehicle (not shown). The endless drive arrangement 10 includes an endless drive member 14 which receives power from certain elements such as the engine crankshaft shown at 16 and transmits the power to certain other elements such as the shafts of certain accessories such as the drive shaft 18 of a water pump 20. Other example accessories shown include an MGU 21. Power transmission to the endless drive member 14 from the crankshaft 16 and from the endless drive member 14 to the shafts 18 of the accessories may be via a rotary drive member 22 on each shaft 18. A tensioner 24 is shown engaged with the endless drive member 14 for maintaining tension in the endless drive member 14. For readability, the endless drive member 14 may be referred to as a belt 14 and the rotary drive members 22 may be referred to as pulleys 22, however it will be understood by one skilled in the art that any suitable endless drive member and any suitable rotary drive member could be used. The belt 14 shown is an asynchronous (non-toothed) belt and the pulleys shown are asynchronous (non-toothed) pulleys. Other examples of suitable endless drive members and rotary drive members include, for example, a timing belt and toothed pulleys, a timing chain and sprockets. Other means of driving the water pump 20 from the crankshaft 16 could be used, which do not employ an endless drive member, such as a drive gear on the crankshaft and a driven gear on the drive shaft 18 for the water pump 20.

The water pump 20 is used to cool the engine 12. In order for an engine to have low emissions and good fuel economy, it is beneficial for the temperature in the cylinders, where fuel combustion occurs, to be sufficiently high, without being so high that the engine itself is at risk of damage.

Because the water pump 20 is driven by the crankshaft 16 via the belt 14, the speed of the water pump 20 increases and decreases with the rpm of the engine 12. In order to control the flow of water from the water pump 20 so that the engine receives sufficient cooling but not too much cooling, the water pump 20 employs features that permit control of the flow rate of coolant therefrom, independent of the speed of the water pump 20. These features permit control of the flow rate without significant impact to the efficiency of the water pump 20 in at least some situations and embodiments.

Figure 3:
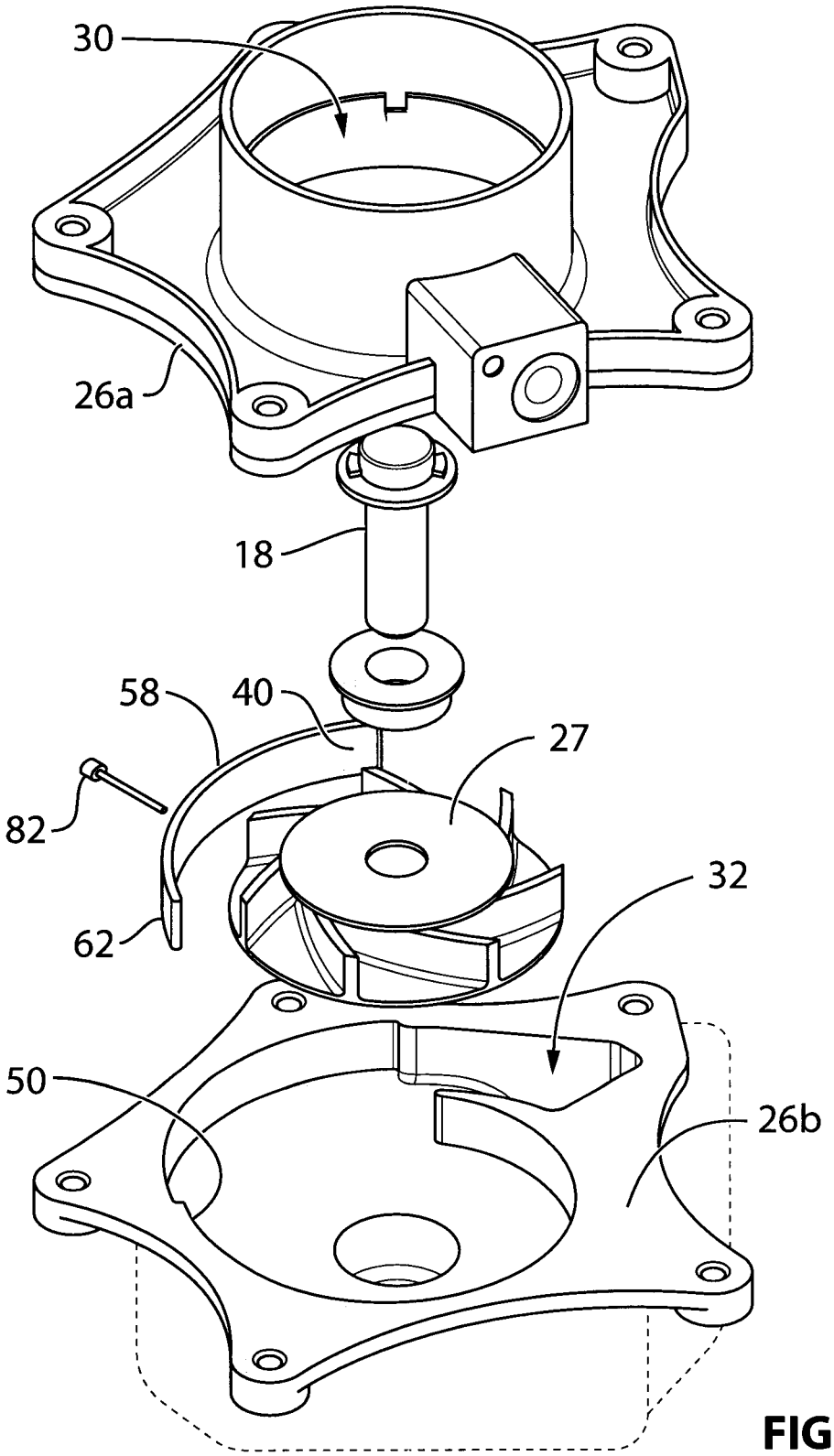
FIG. 3 is a perspective exploded view of the pump shown in FIG. 2 with some minor changes to selected components and without an actuator.
Figure 4:
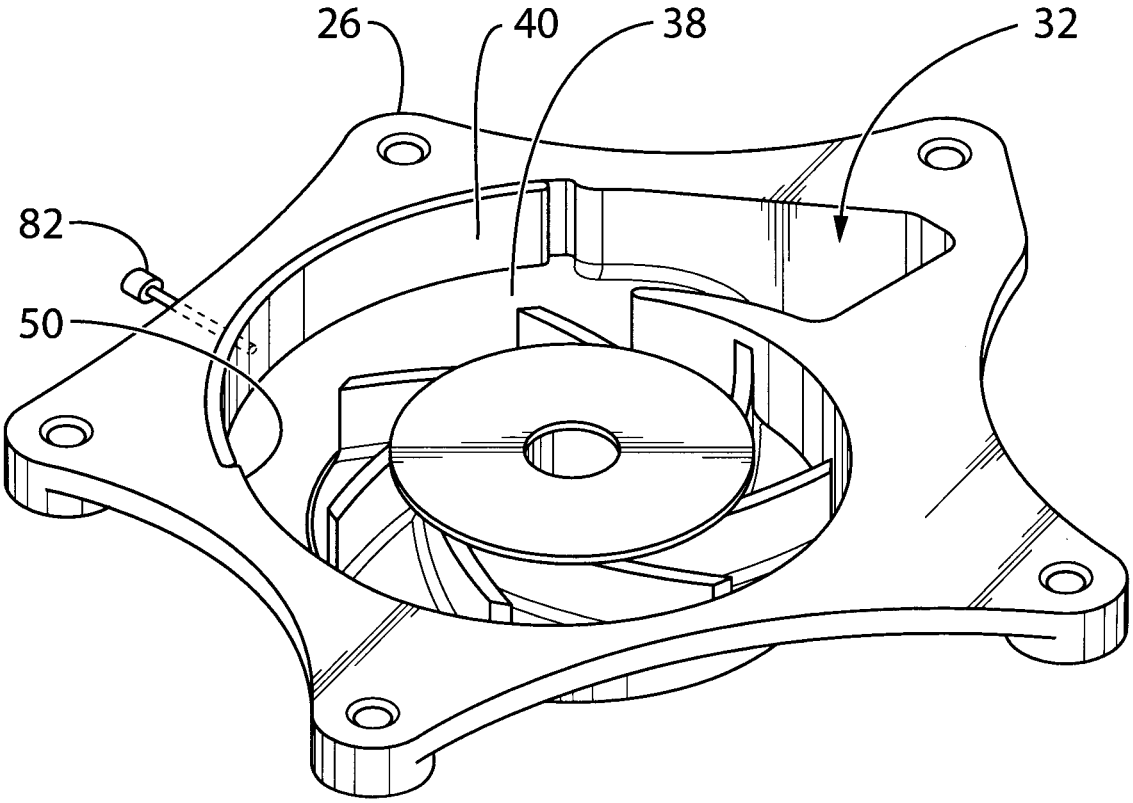
FIG. 4 is a perspective view of the pump shown in FIG. 3, with some further components removed.

The water pump 20 is shown only schematically in FIG. 1. The water pump 20 is shown more clearly in FIGS. 2-4. The water pump 20 includes a pump housing 26 and an impeller 27. The pump housing 27 may be formed from a first pump housing portion 26*a* and a second pump housing portion 26*b* which are sealingly joined together in any suitable way, such as by a plurality of mechanical fasteners 28. The pump housing 26 may be fixedly connected to any suitable stationary structure such as the block of the engine (shown at 29 in FIG. 1). The pump housing 26 includes a pump inlet 30 (FIG. 3) and a pump outlet 32 (FIG. 4). The pump inlet 30 is configured for receiving a liquid and for transport of the liquid to the impeller 27. The pump outlet 32 is configured for receiving liquid from the impeller 27 and transporting the liquid out of the pump 20.

The impeller 27 is rotatably supported in the pump housing 26 for rotation about an impeller axis A. The impeller 27 has an impeller inlet 34 that is configured for drawing in liquid from the pump inlet 30 during rotation of the impeller 27, and an impeller outlet 36 configured for discharging liquid in a generally radial direction.

The pump housing 26 has an impeller outlet receiving chamber 38 radially outside the impeller 27 for transporting liquid from the impeller outlet 36 to the pump outlet 32. In the embodiments shown the chamber 38 is in surrounding relationship with the entire impeller 27.

Figure 5A:
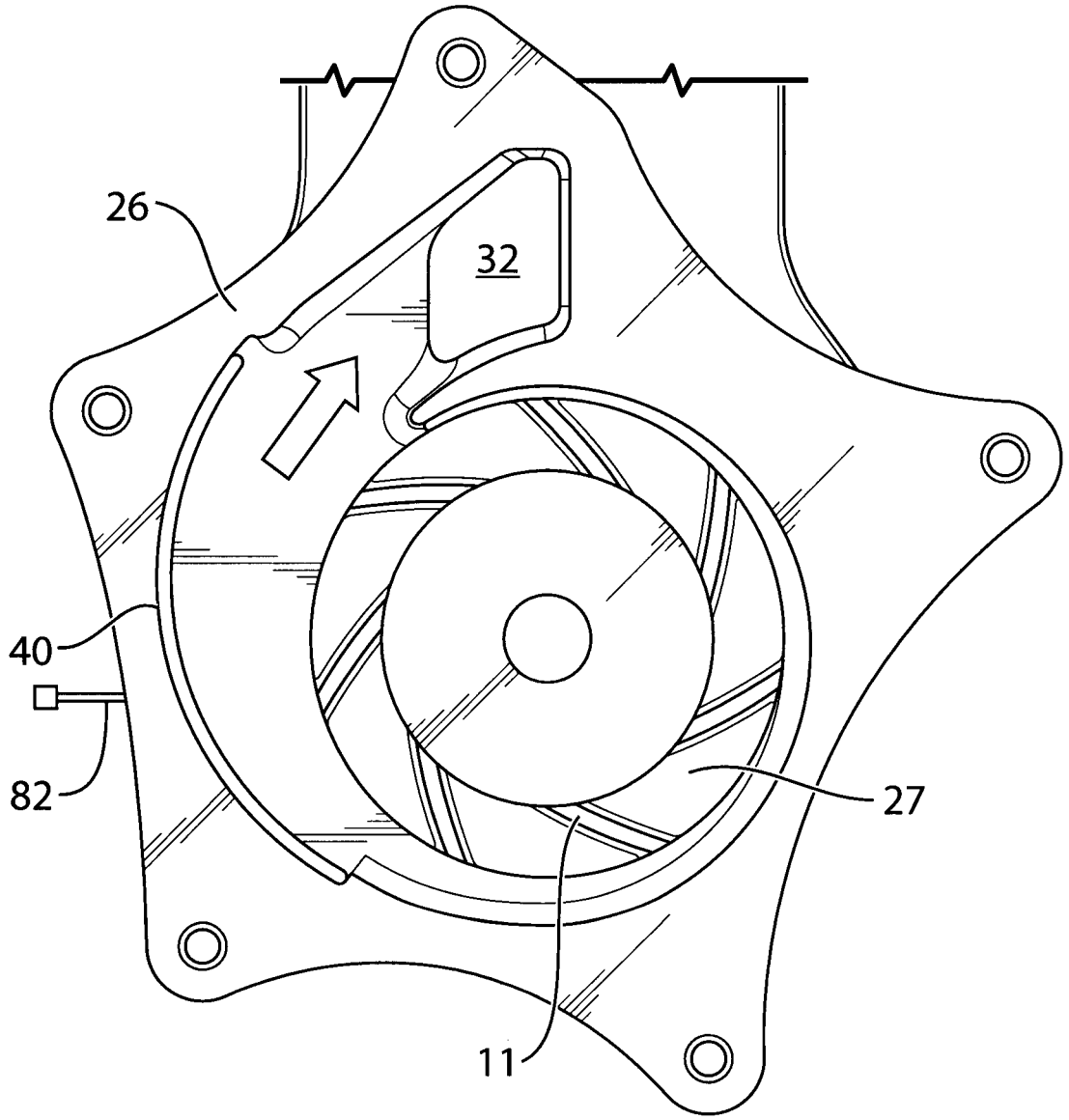
FIG. 5A is a side view of the pump shown in FIG. 4, wherein a diverter that controls flow out of the pump is in a first position.
Figure 5B:
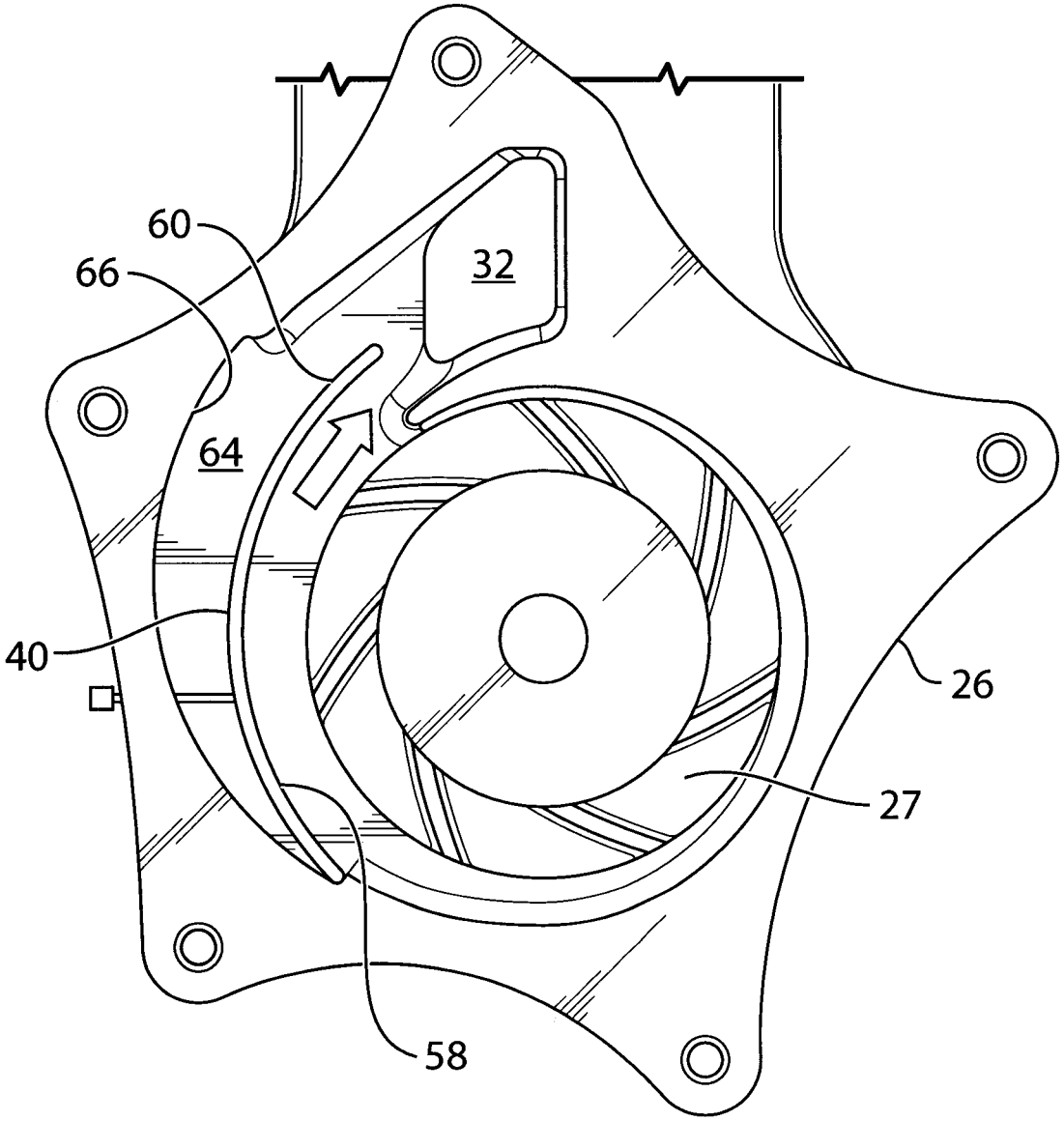
FIG. 5B is a side view of the pump shown in FIG. 4, wherein a diverter that controls flow out of the pump is in a second position.

The pump housing further includes a diverter 40. The diverter 40 has an upstream end 42 that is pivotally connected (e.g. by way of a pin that extends from the diverter 42 into receiving apertures in the housing portions 26*a* and 26*b*) at a first location 44 in the impeller outlet receiving chamber 38 and a downstream end 46 at a second location 48 in the impeller outlet receiving chamber 38. The diverter 40 is pivotable between a first position (FIG. 5A) and a second position (FIG. 5B). In the first position the diverter 40 provides a first restriction to flow out from the pump housing 26, and the diverter 40 forms at least a portion of a volute 50 around at least a portion of the impeller 27. A volute is a region of the impeller outlet receiving chamber 38 that has a cross-sectional area that increases progressively from the upstream end 42 of the diverter 40 to the downstream end 46 of the diverter 40. In some embodiments, (as shown in FIG. 5A) the volute 50 occupies substantially the entire impeller outlet receiving chamber 38. In some embodiments, the volute 50 has a cross-sectional area that increases progressively from the upstream end 42 of the diverter 40 towards the downstream end 46 of the diverter 40 sufficiently that a speed of the liquid flowing through the volute 50 remains substantially constant during rotation of the impeller 27 at a selected rpm. It will be noted that the speed of the liquid flowing through the volute 50 (or through substantially any passageway) will vary over the cross-sectional area of the volute 50. However, at any point along the length of the volute 50, the liquid has an average speed taking into account the speed profile over the cross-sectional area. The volute 50 may be shaped such that the average speed of the liquid remains substantially constant along the circumferential length of the volute 50.

The selected rpm may be selected to be an rpm that the impeller 27 runs at a relatively high percentage of the time that the engine 12 is on. In some embodiments, the volute 50 may have a generally spiral shape, or it may have some other shape having a progressively increasing cross-sectional area in a downstream direction.

In the embodiment shown, the pump housing 26 immediately upstream from the diverter 40 forms a first portion of the volute 50 and the diverter 40 forms a second portion of the volute 50 when in the first position.

In the second position (FIG. 5B) the diverter 40 provides a second restriction to flow out from the pump outlet 32 that is greater than the first restriction. The diverter 40 may provide the second restriction by cooperating with a tongue 52 that is part of the pump housing 26, to restrict flow out of the impeller outlet receiving chamber 38. As will be understood by one skilled in the art, the tongue 52 is the portion of the pump housing 26 that separates a downstream end 54 of the impeller outlet receiving chamber 38 and an upstream end 56 of the impeller outlet receiving chamber 38.

The diverter 40 has a first face 58 that faces the impeller 27 and a second face 60 that faces away from the impeller 27, and a peripheral edge 62 between the first and second diverter faces 58 and 60. The diverter 40 need not have a seal between the peripheral edge 62 and the surrounding walls of the pump housing 26. For example, it is possible for the peripheral edge 62 to be spaced from the surrounding walls of the pump housing 26 sufficiently to permit passage of liquid therebetween from the first diverter face 58 to the second diverter face 60 (i.e. into the space shown at 64 between the second diverter face 60 and the housing wall shown at 66) during movement of the diverter 40 from the first position to the second position. Because liquids are generally substantially incompressible, the volume of liquid in the space 64 buttresses the diverter 40 and the volume of liquid surrounding the peripheral edge 62 of the diverter 40 acts as a wall along with the diverter 40 so as to guide liquid flow smoothly around the impeller output receiving chamber 38, towards the pump outlet 32.

Figure 6:
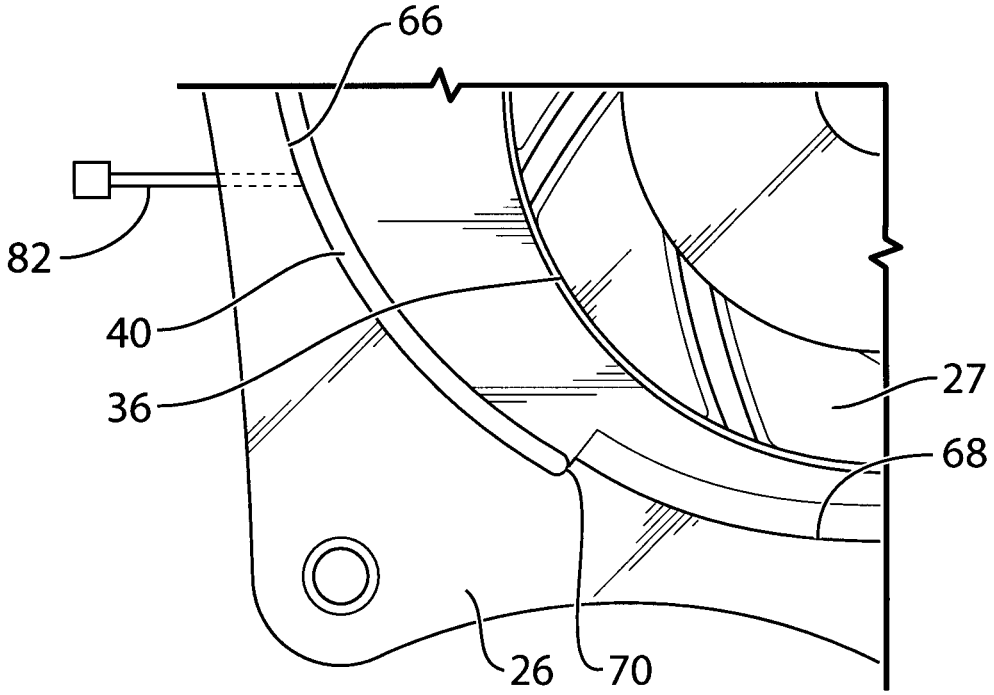
FIG. 6 is a magnified internal elevation view of a portion of the pump shown in FIG. 4 in the first position shown in FIG. 5A.

As shown best in FIG. 6, in some embodiments, when the diverter 40 is in the first position, the diverter 40 is substantially flush with a portion (shown at 68 of the pump housing 26 immediately upstream from the diverter 40. For the purpose of the present disclosure, the term 'flush' means that, aside from a relatively small valley 70 that provides clearance so as to permit movement of the diverter 40 between the first and second positions, the shape of the first diverter face 58 is substantially continuous with the shape of the portion 68 immediately upstream from the diverter 40.

Figure 2:
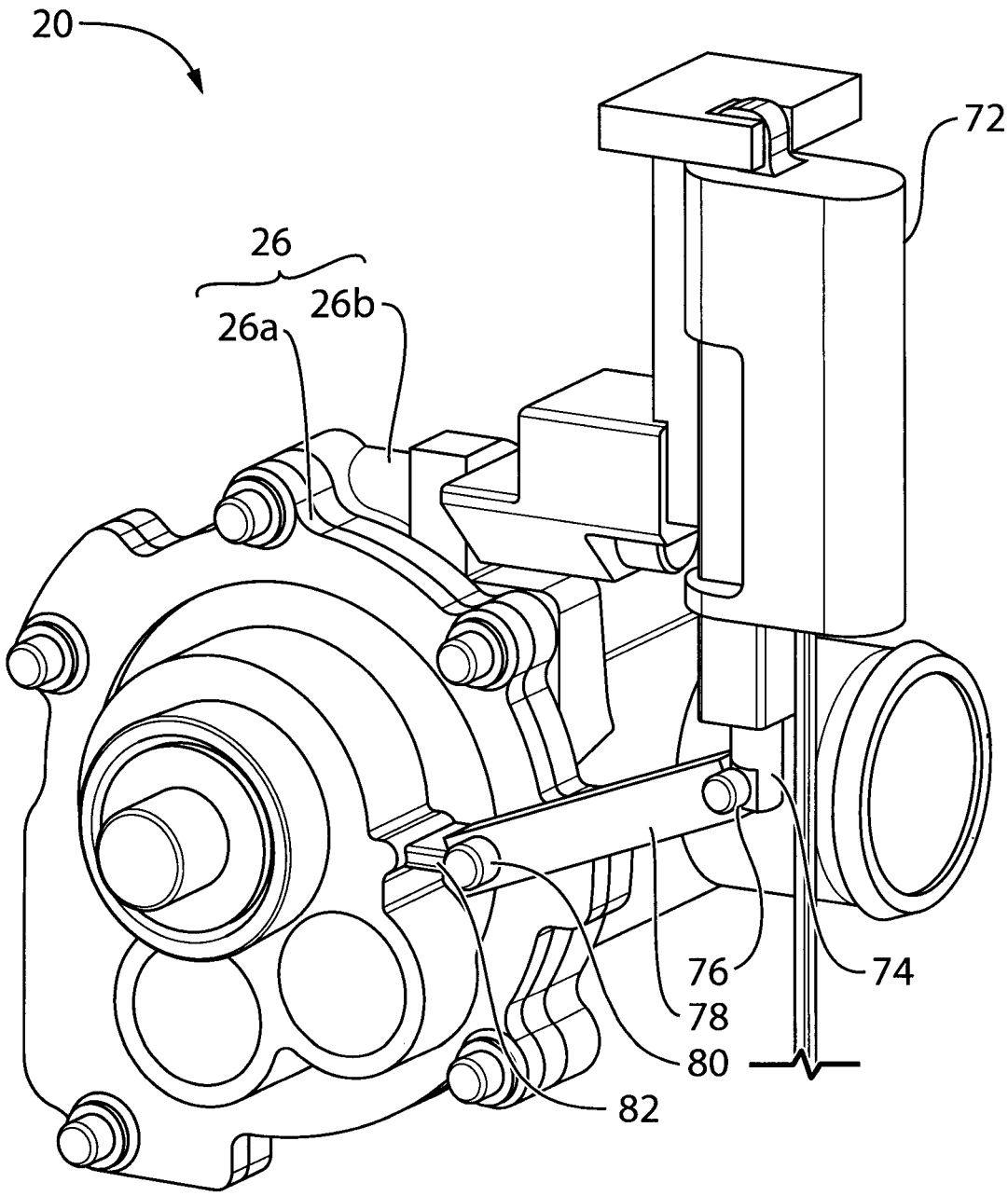
FIG. 2 is a perspective view of the pump shown in FIG. 1.

Reference is made to FIG. 2, which shows an actuator 72 for the diverter 40. The diverter itself is not shown in FIG. 2, but is shown in other figures such as FIGS. 5A and 5B as noted above. The actuator 72 is operable to drive the diverter 40 between the first and second positions (FIGS. 5A and 5B respectively). In some embodiments, the actuator 72 may be a linear actuator, such as a solenoid, an electric motor-driven leadscrew actuator, a hydraulic or pneumatic actuator, or any other suitable type of linear actuator. The actuator 72 includes an actuator output member 74 that connects pivotally (e.g. via a pin joint) to a first end 76 of an intermediate link 78, which has a second end 80 that, in turn connects pivotally (e.g. via another pin joint) to a diverter drive member 82 that passes through the pump housing 26 and engages the diverter 40. It will be noted that an alternative version of the diverter drive member 82 is shown in FIGS. 4, 5A and 5B, however, they are functionally the same. To drive the diverter 40 from the first position to the second position, the actuator output member 74 is driven to extend (e.g. by an electric motor), which in turn drives the diverter drive member 82 into the housing 26 via the intermediate link 78 so as to drive the diverter 40 away from the housing wall 66 to the second position. To drive the diverter 40 from the second position to the first position, the actuator 72 need only be operated to retract the actuator output member 74, which in turn withdraws the diverter driver member 82 (via the intermediate link 78). The diverter driver member 82 may be withdrawn sufficiently that it does not project into the interior of the pump housing 26. As liquid is ejected from the impeller 27 into the impeller outlet receiving chamber 28, it will push the diverter 40 back to the first position.

Figure 7:
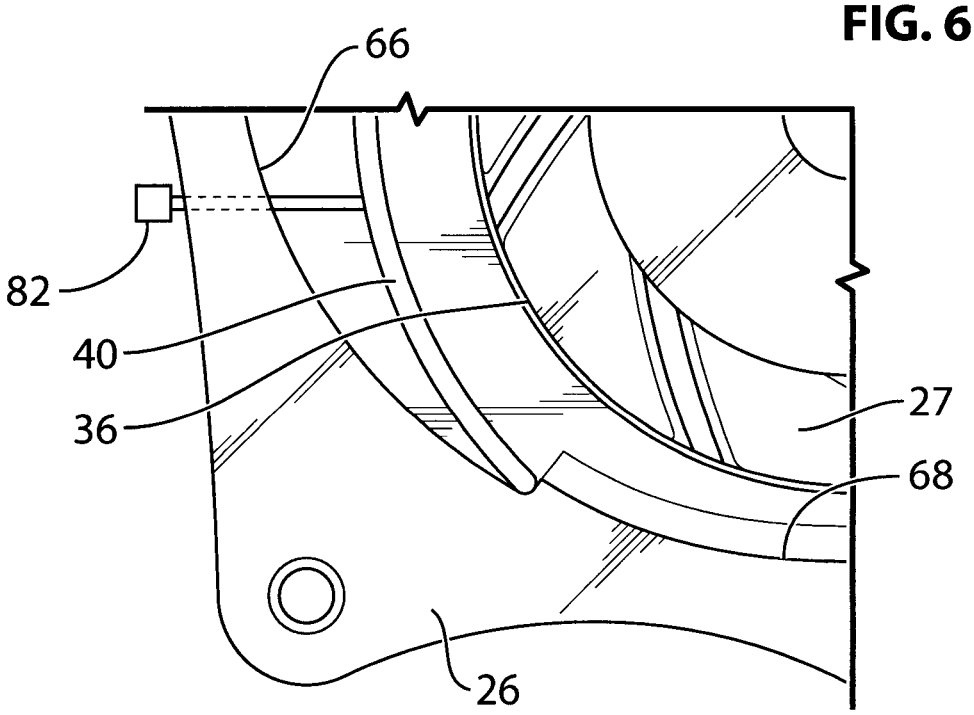
FIG. 7 is a magnified internal elevation view of a portion of the pump shown in FIG. 4 with the diverter in a different first position compared to the first position shown in FIG. 5A.

It will be noted that the diverter 40 need not be fully engaged with the housing wall 66 when in the first position. For example, the diverter driver member 82 may have a withdrawn position in which it still projects by some amount into the interior of the housing 26 (as shown in FIG. 7). Thus, the diverter 40 may form part of the volute while still spaced from the housing wall 66.

Depending on the type of actuator 72 used, the diverter 40 may be infinitely adjustable in position between the first and second positions by the actuator 72. For example, if the actuator 72 is a leadscrew actuator, then the diverter 40 may be infinitely adjustable, because the actuator 72 is infinitely adjustable. Alternatively, the actuator 72 may be a two position actuator such as a solenoid or hydraulic or pneumatic ram, which are not infinitely adjustable in position, and therefore, the diverter 40 would, in such embodiments, not be infinitely adjustable.

Figure 8B:
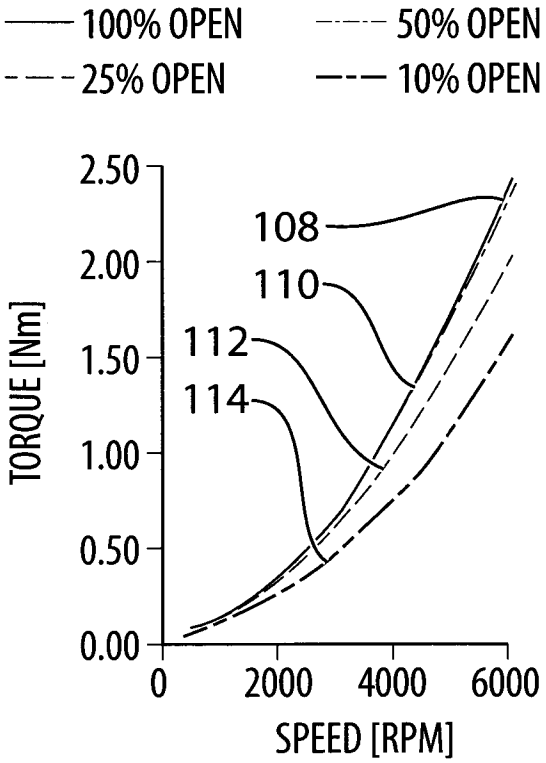
FIGS. 8A-8C are graphs illustrating aspects of the performance of the pump shown in FIG. 4.
Figure 8A:
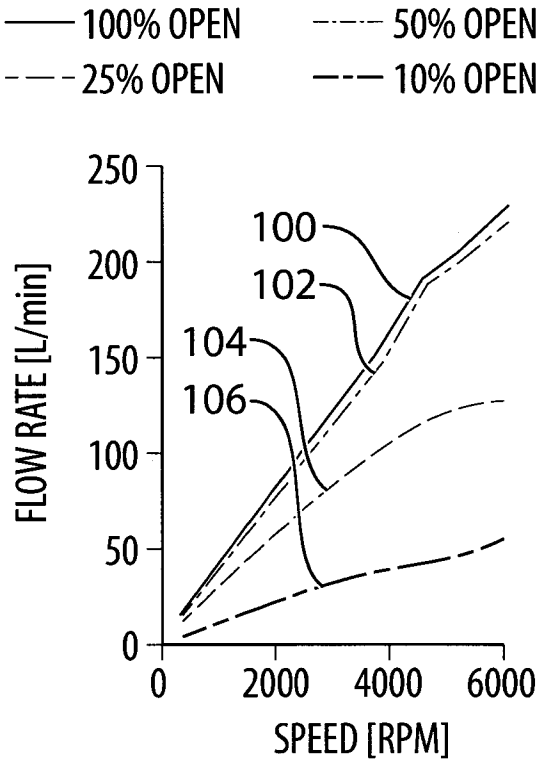

FIG. 8A is a graph showing the flow rate v. speed of the pump 20 at several different positions for the diverter 40. The curves shown include curves 100, 102, 104 and 106 respectively which represent the relationship when the diverter 40 is open 100%, 50%, 25% and 10% of maximum, respectively. As can be seen, the flow rates when the diverter is only open 25% and 10% remain significant fractions of the flow rates when the diverter is fully open.

FIG. 8B is a graph showing the torque v. speed of the pump 20 at the same diverter positions wherein curves 108, 110, 112 and 114 represent the diverter positions of 100%, 50%, 25% and 10%, respectively.

Figure 8C:
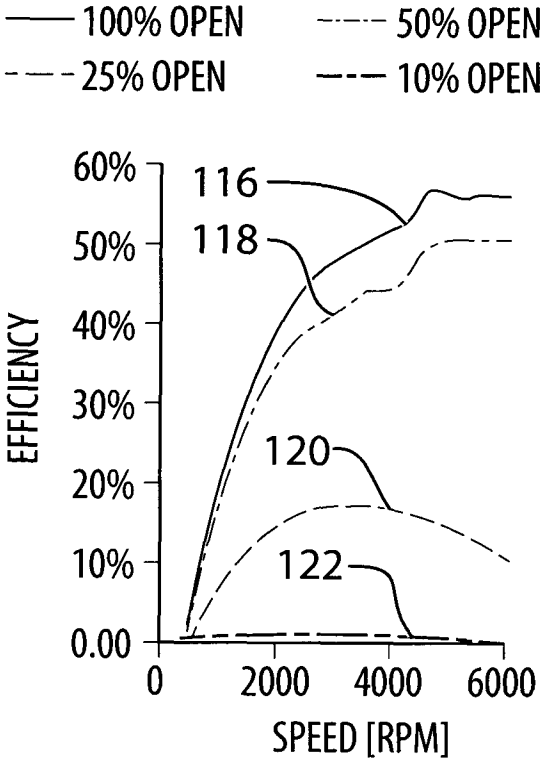

FIG. 8C is a graph showing the pump efficiency v. speed for the pump 20. As can be seen, where the curves shown at 116, 118, 120 and 122 represent the diverter at 100%, 50%, 25% and 10%, respectively. As can be seen, the pump efficiency remains high even with the diverter open only 50% over a large range of speeds.

By using the pump 20, as opposed to a standard water pump, for cooling the engine 12, the amount of coolant that is sent to the engine 12 can be controlled. Several advantages are achieved by controlling the amount of coolant that flows to the engine 12. In general, there are many situations where the amount of coolant being sent to an engine by a standard water pump is more than the engine 12 requires. As a result, the temperature of the engine is lower than is needs to be to prevent overheating. As a result the temperature at which combustion is taking place in the engine is lower than it could otherwise be, which can negatively impact combustion efficiency, which directly affects fuel economy and emissions negatively. By providing the pump 20 and by reducing the flow from the pump 20 by adjustment of the position of the diverter 40 when the engine 12 is cooler than it needs to be, the engine 12 can be operated at a warmer temperature, resulting in more efficient combustion of fuel, thereby resulting in fewer emissions and better fuel economy.

Figure 9:
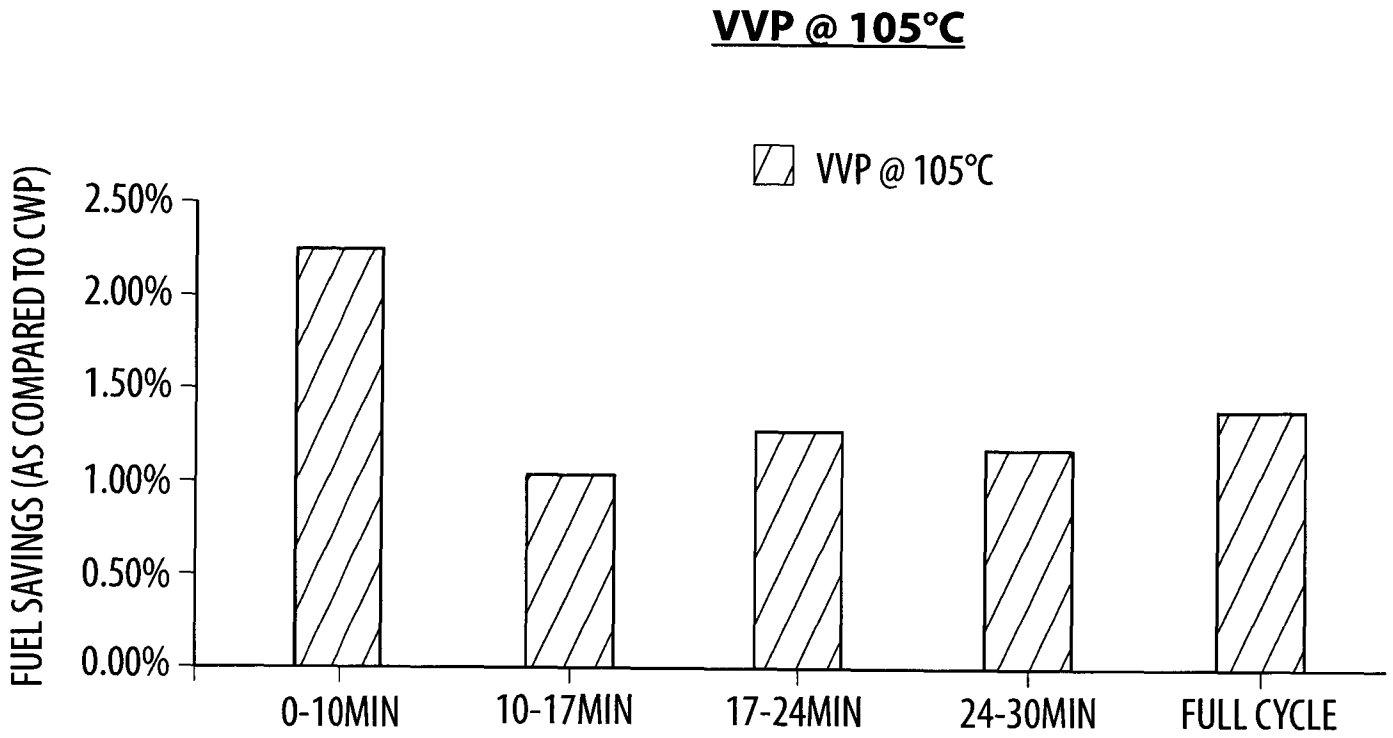
FIG. 9 is a graph illustrating the improvement in fuel economy provided by a pump in accordance with the present disclosure relative to a standard water pump.

FIG. 9 is a graph showing the improvement in fuel economy that was measured during testing of a vehicle with the pump 20 as compared to the same vehicle using a standard water pump. As can be seen, use of the pump 20 results in a greater than 2% improvement in fuel economy in the first 10 minutes or a predetermined drive cycle and a nearly 1.5% improvement in fuel economy in the overall drive cycle.

Figure 10:
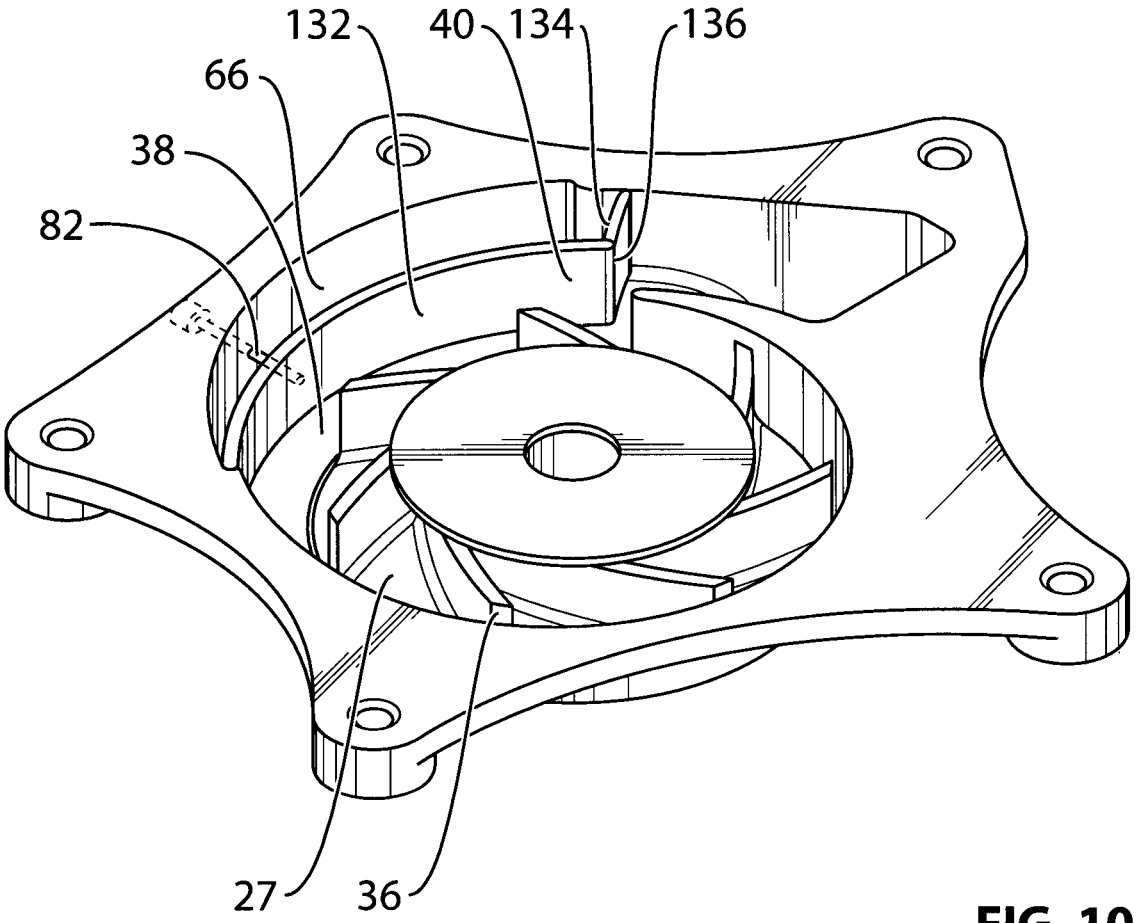
FIG. 10 is a perspective view of a variant of the pump.

FIG. 10 shows the pump 20 with a diverter 130, which is similar to the diverter 40, except that the diverter 130 includes a main portion 132, and a downstream extension 134. The main portion 132 is similar to the diverter 40. The downstream extension 134 is not shown in the embodiment in FIGS. 3-9. The downstream extension 134 is particularly functional when the diverter 130 is in the second position, as shown in FIG. 10. As can be seen, the downstream extension 134 inhibits the flowback of liquid into the space 64 behind the diverter 130 when the liquid flows in the impeller outlet receiving chamber 38 past the downstream end (shown at 136) of the diverter 130.

Figure 11:
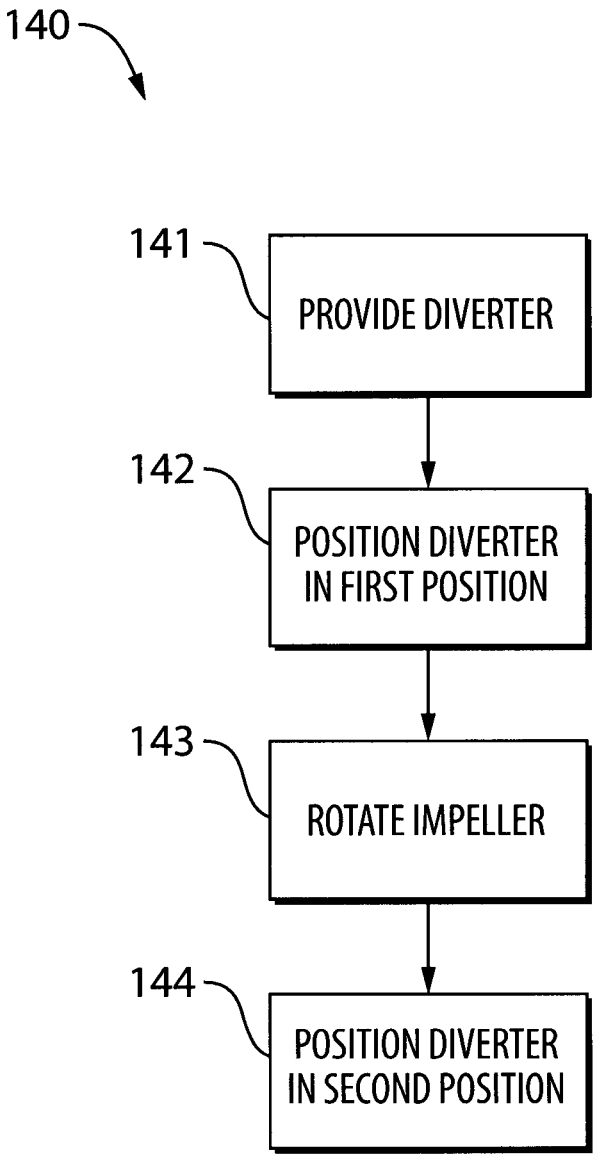
FIG. 11 is a flow diagram relating to operation of the pump shown in FIGS. 3-9.
Figure 13:
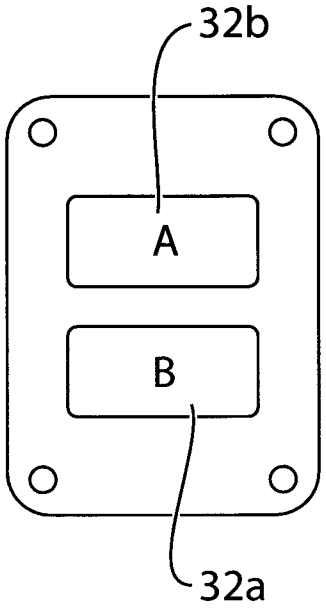
FIGS. 12-14 are sectional views of another variant of the pump.
Figure 12:
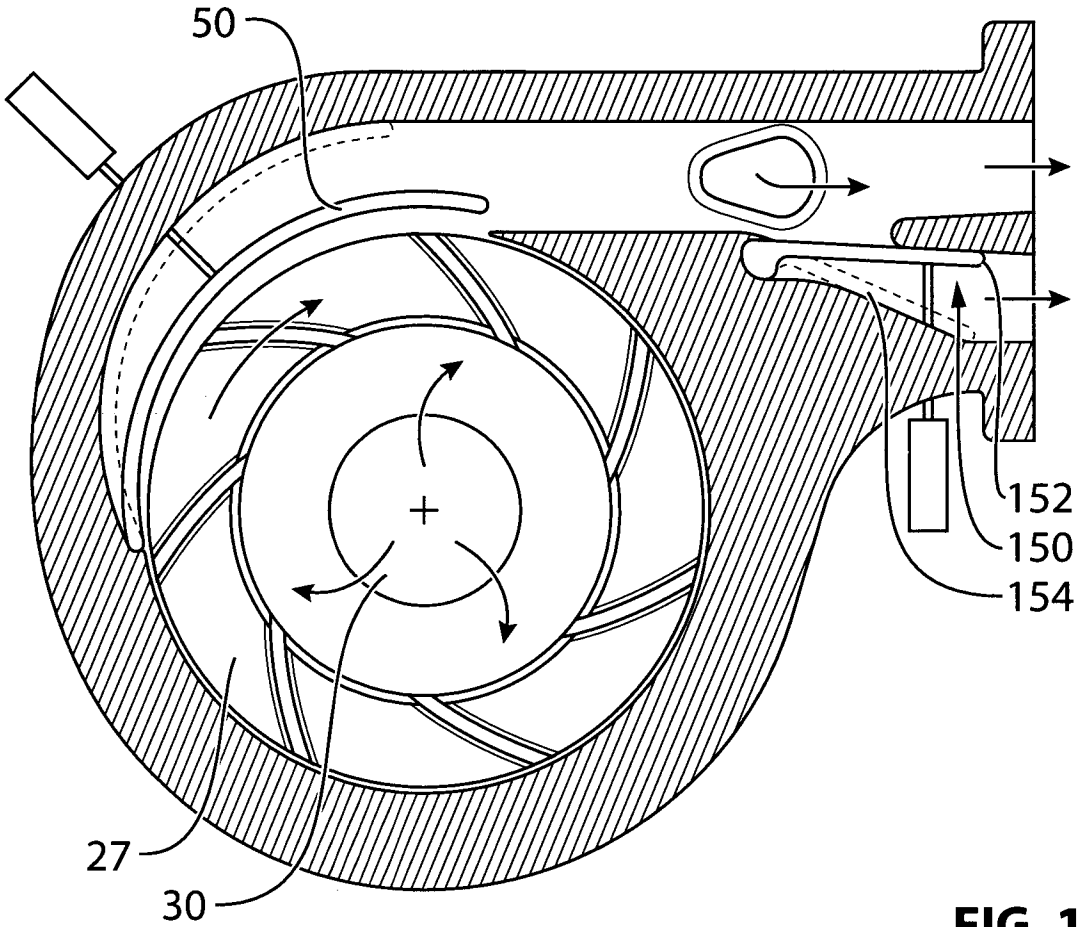

Reference is made to FIG. 11, which shows a flow diagram of a method 140 of operating a pump. Reference numbers relating to the pump 20 are used as an example here however it will be understood that the pump operated by the method could be something other than the pump 20. In relation to the example embodiment of the method 140 the pump 20 has a pump housing having a pump inlet 30 and a pump outlet 32, and an impeller 27 that is rotatably supported in the pump housing 26 for rotation about an impeller axis A. The impeller has an impeller inlet 34 configured for drawing in liquid from the pump inlet 30 during rotation of the impeller 27, and an impeller outlet 36 configured for discharging liquid in a generally radial direction. The pump housing 26 has an impeller outlet receiving chamber 38 positioned radially outside the impeller 27 for transport of liquid from the impeller outlet 36 to the pump outlet 32. The method includes step 141 which includes providing a diverter 40 that is part of the pump housing 26. The diverter 40 has an upstream end 42 that is pivotally connected at a first location 44 in the impeller outlet receiving chamber 38 and a downstream end 46 that is at a second location 48 in the impeller outlet receiving chamber 38. The method further includes step 142 which includes positioning the diverter 40 in a first position in which the diverter 40 provides a first restriction to flow out from the pump housing 26, and in which the diverter 40 forms at least a portion of a volute 50 around at least a portion of the impeller 27. The volute 50 has a cross-sectional area that increases progressively from the upstream end 42 of the diverter 40 to the downstream end 46 of the diverter 40. The method further includes step 143 which includes rotating the impeller 27 while the diverter 40 is in the first position to drive flow through the pump outlet 32. The method further includes step 144 which includes positioning the diverter 40 in a second position in which the diverter 40 provides a second restriction to flow out from the pump outlet that is greater than the first restriction.

Reference is made to FIGS. 12, 13, 14 and 15, which shows another variant of the pump 20, in which the pump housing 26 has a pump inlet 30, a first pump outlet 32*a* and a second pump outlet 32*b*. The impeller 27 is configured for drawing in liquid generally axially from the pump inlet 30 during rotation of the impeller 27 and is configured for discharging liquid generally radially towards at least one of the first and second pump outlets 32*a* and 32*b*.

The pump 20 further includes a valve 150 positioned downstream from the volute 50. The valve 150 is movable between a first valve position (shown in solid lines at 152) and a second valve position (shown in broken lines at 154) to control liquid flow through the second pump outlet 32*a*. In some embodiments, the impeller 27 is a first impeller and the pump 20 further includes a second impeller 156 that is operable independently of the first impeller 27 and is configured to draw liquid in from the pump inlet 30 and to discharge liquid to the first and second pump outlets 32*a* and 32*b*.

Figure 14:
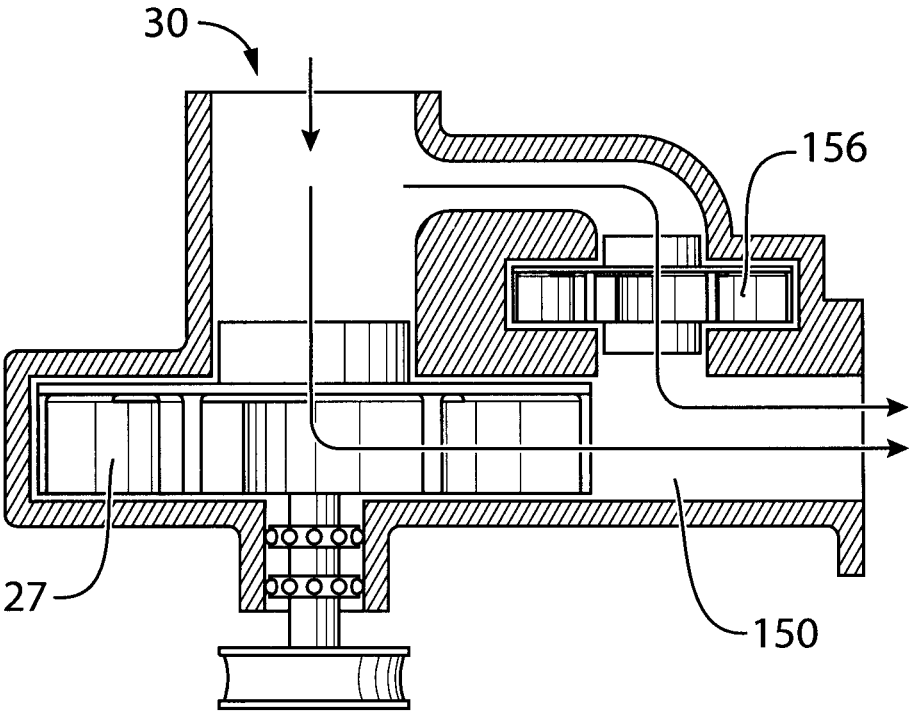
Figure 15:
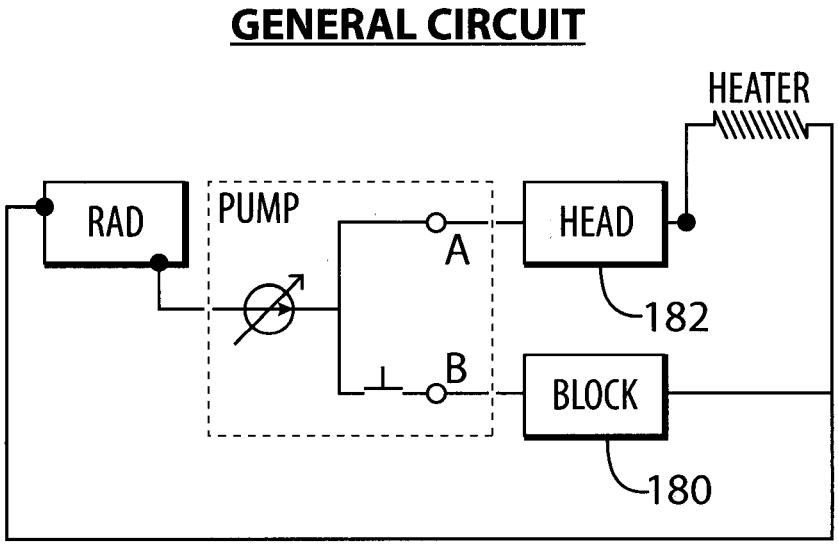
FIG. 15 is a cooling system diagram for an engine in a vehicle using the pump shown in FIGS. 12-14.
Figure 16:
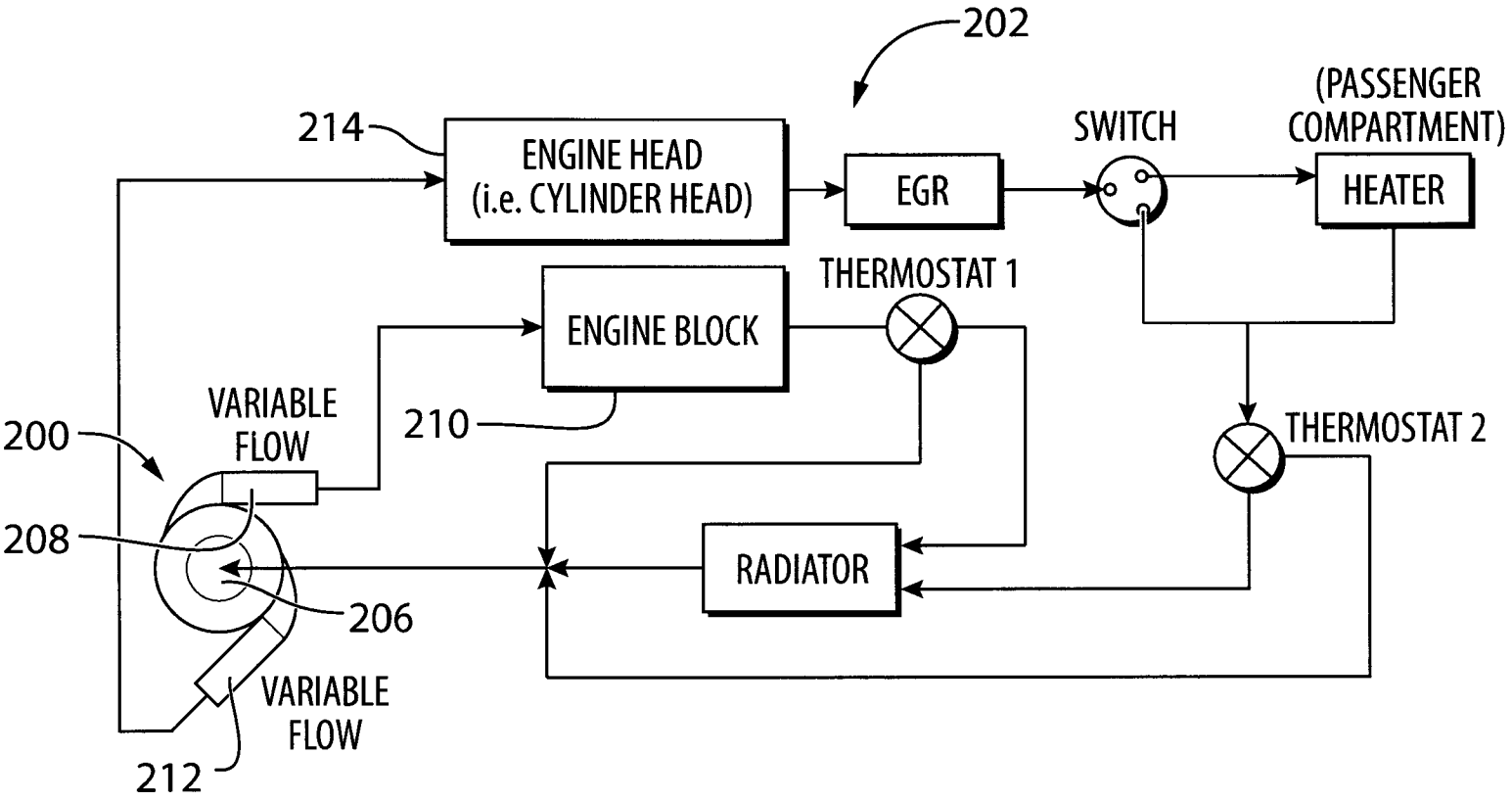
FIG. 16 is another cooling system diagram for an engine in a vehicle using another pump having two diverters.

The pump 20 may be incorporated into a cooling system as shown in FIG. 14. As can be seen, the first pump outlet 32*a* may be connected to the engine block shown at 180, while the second pump outlet 32*b* may be connected to the cylinder head shown at 182. As a result the pump 20 can be used to cool the cylinder head 182 and the engine block 180 using different control strategies.

Figure 17:
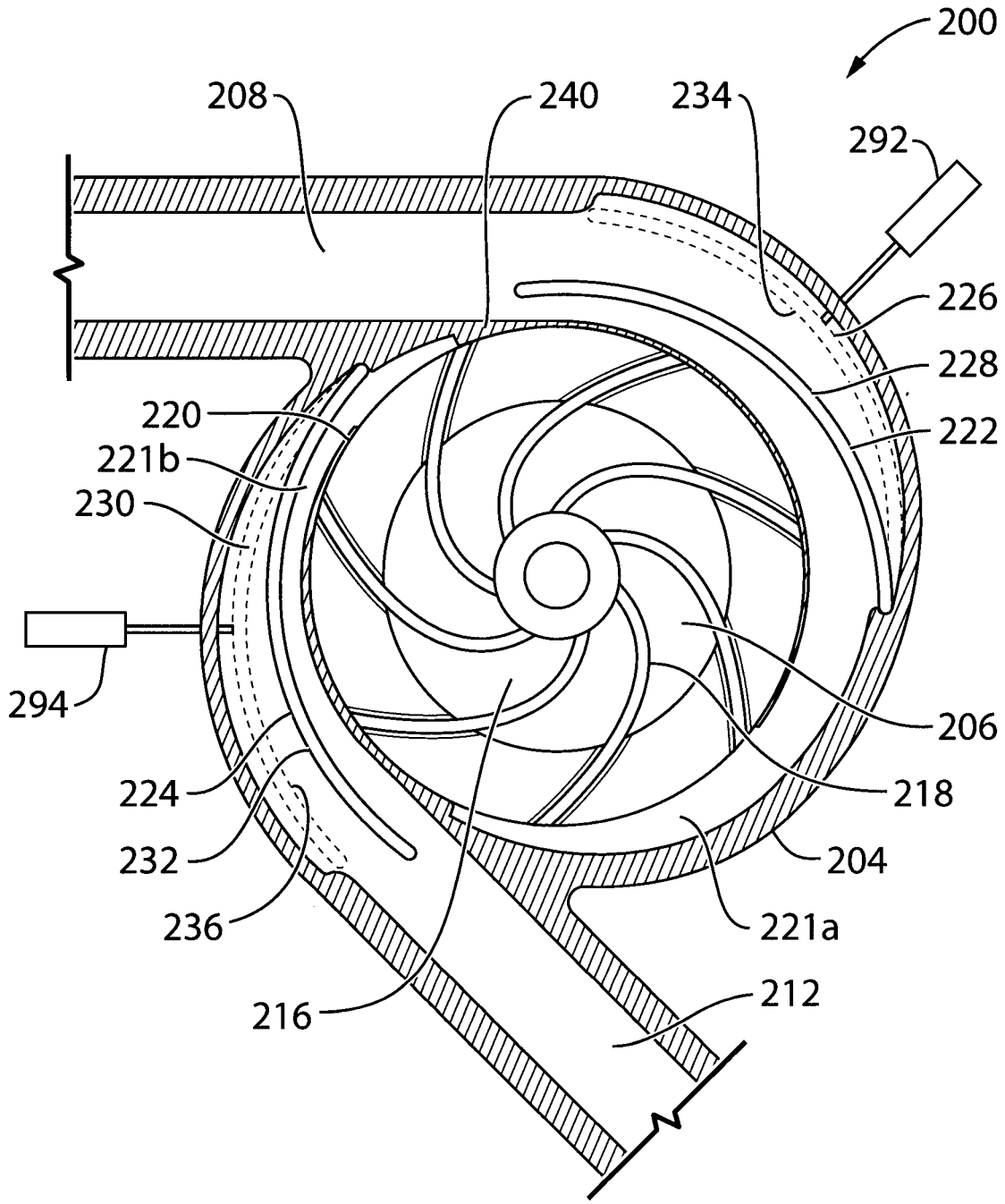
FIG. 17 is an illustration of the pump having two diverters.

Reference is made to FIG. 17, which shows a pump 200 that may be similar to the pump 20, but which includes first and second pump outlets and first and second diverters that are similar to the diverter 40. The pump 200 is for pumping liquid through a vehicular cooling system such as is shown at 202 in FIG. 17. The pump 200 includes a pump housing 204 that may be similar to the pump housing 26 but which has a pump inlet 206, a first pump outlet 208 fluidically connected to a first cooling load (e.g. an engine block shown at 210) and a second pump outlet 212 fluidically connected to a second cooling load (e.g. a cylinder head shown at 214. The pump 200 further includes an impeller 216 rotatably supported in the pump housing 204, and has an axially oriented impeller inlet 218 configured for drawing in liquid generally axially from the pump inlet 206 during rotation of the impeller 216, and a radially oriented impeller outlet 220 configured for discharging liquid generally radially from the impeller 216 towards the first and second pump outlets 208 and 212. A first cooling load diverter 222 (which may be used to control cooling to the engine block and which may therefore be referred to as an engine block diverter) and a second cooling load diverter 224 (which may be used to control cooling to the cylinder head and which may therefore be referred to as a cylinder head diverter) are included as part of the pump housing 204. The first cooling load diverter 222 is movable between a first position for the first cooling load diverter 222 shown in dashed lines at 226 in FIG. 17 in which the first cooling load diverter 222 provides a first flow restriction to flow out from the first pump outlet 208 and a second position (shown at 228 in solid lines in FIG. 17) for the first cooling load diverter 222 in which the first cooling load diverter 222 provides a second flow restriction to flow out from the first pump outlet 208 that is greater than the first flow restriction to flow out from the first pump outlet 208. The second cooling load diverter 224 is movable between a first position (shown in FIG. 17 in dashed lines at 230) for the second cooling load diverter 224 in which the second cooling load diverter 224 provides a first flow restriction to flow out from the second pump outlet 212, and a second position (shown in FIG. 17 in solid lines at 232) for the second cooling load diverter 224 in which the second cooling load diverter 224 provides a second flow restriction to flow out from the second pump outlet 212 that is greater than the first flow restriction to flow out from the second pump outlet 212. When the first cooling load diverter 222 is in the first position for the first cooling load diverter 222 the first cooling load diverter 222 forms at least a portion of a first volute 234 radially outside the impeller 216. When the second cooling load diverter 224 is in the first position for the second cooling load diverter 224, the second cooling load diverter 224 forms at least a portion of a second volute 236 radially outside the impeller.

Optionally the pump 200 may be driven by a same rotary drive member 22 similar to that which can be used to drive the pump 20 (e.g. a pulley that is driven by a belt that is driven by an engine crankshaft, wherein the rotary drive member 22 is operatively connected to the impeller 216 via a drive shaft 18. Optionally in the second position for the first cooling load diverter 222, the first cooling load diverter 222 permits substantially no liquid flow through the second pump outlet (e.g. it substantially engages a first tongue 240 in the pump housing 204). Actuators for the diverters 222 and 224 are shown at 292 and 294 and may be the same as the actuator 72.

Figure 18:
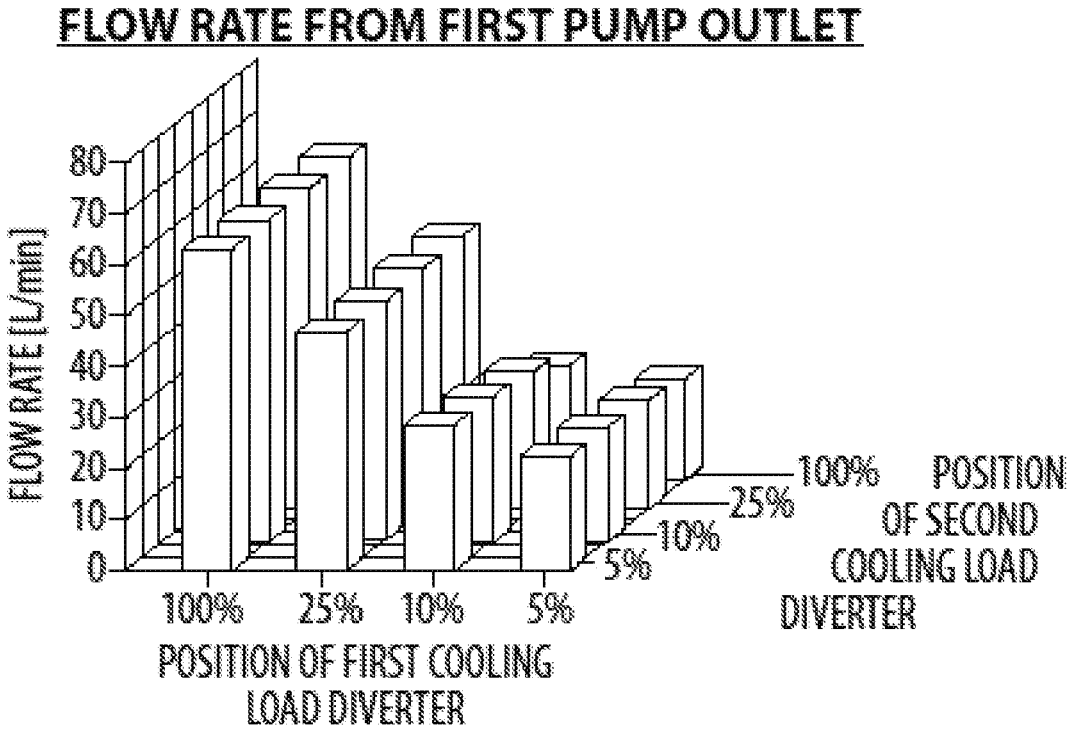
FIGS. 18 and 19 illustrate the effect that movement of one of the diverters from the pump shown in FIG. 17 has on the flow past the other diverter.
Figure 19:
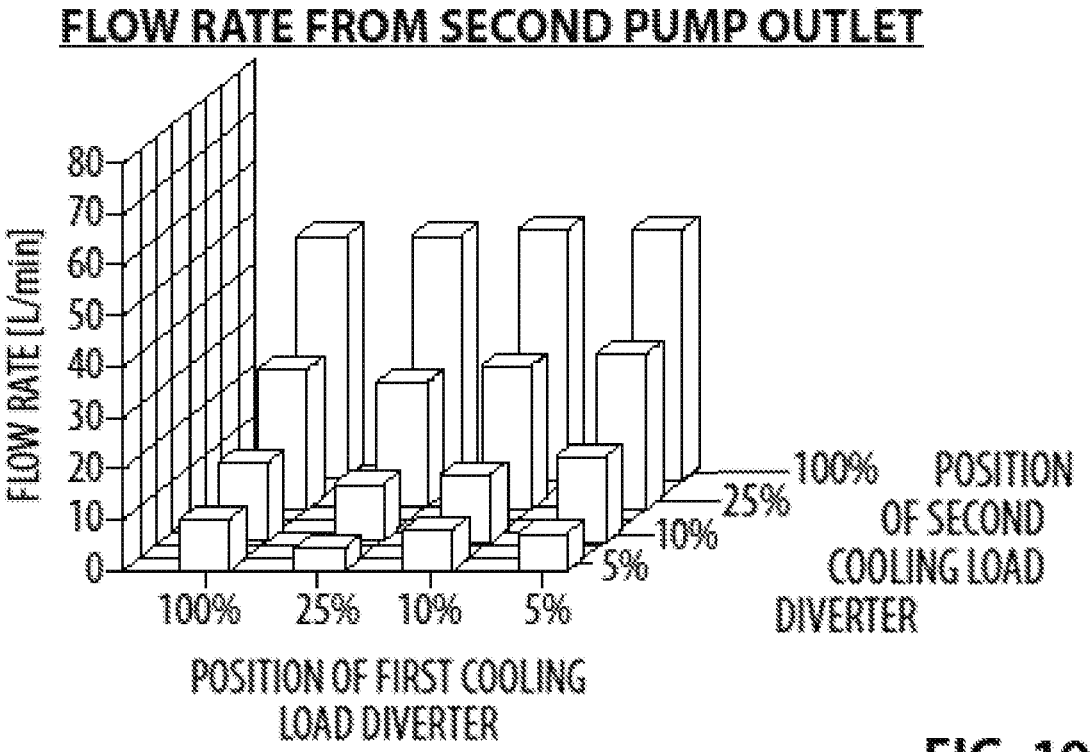

Over a selected range of engine rpm, movement of the first cooling load diverter 222 between the first and second positions for the first cooling load diverter 222 while maintaining the second cooling load diverter in the first position for the second cooling load diverter causes less than a 10 percent change in liquid flow through the second pump outlet. Optionally, the selected range of engine rpm includes an engine rpm of about 1000 rpm. Over the selected range of engine rpm, movement of the first cooling load diverter 222 between the first and second positions for the first cooling load diverter while maintaining the second cooling load diverter in the first position for the second cooling load diverter causes less than a 5 percent change in liquid flow through the second pump outlet. Optionally the selected range of engine rpm includes an engine rpm of about 2000 rpm. As can be seen in FIG. 18, movement of the second cooling load diverter 224 between the 10% open and 100% open positions has very little effect on the flow rate from the first pump outlet 208. Similarly, as can be seen in FIG. 19, movement of the first cooling load diverter 222 between the 10% open and 100% open positions has very little effect on the flow rate from the second pump outlet 212. It has been found experimentally that, above 3000 rpm, the movement of the diverters 222 and 224 have virtually no effect on one another (less than 1% change in the other's flow rate). It has further been found, that, at 2000 rpm, the movement of the diverters has less than about 5% impact on each other. At 1000 rpm, it has been found that the effect is less than about 10%. FIGS. 18 and 19 represent testing carried out at 2000 rpm.

In some embodiments, the pump 20 or 200 may be provided in vehicles employing a 48 VDC electrical system, partial electric vehicles (employing at least one electric drive motor and an engine either to charge the battery and/or to drive the wheels), and full electric vehicles (which employ only one or more electric motors and no engine). It may be desirable in some of these aforementioned embodiments to power the water pump 20 or 200 electrically via a DC motor, as opposed to driving it from a flexible belt drive, as on a regular ICE engine. For example, for 48 volt start/stop engine architectures, it has been stated that some engine manufacturers will tend to drive the water pump, and hence, the heating/cooling system, via a DC electric motor as opposed to the FEAD belt drive, for efficiency purposes. Some fully electric vehicles employ upwards of three sophisticated cooling circuits to cool the lithium ion batteries, the electric motor, the passenger compartment and other systems within the vehicle.

If the water pump impeller 27 or 216 is spun at a highly efficient single pumping speed, then a relatively low cost brushed DC motor could be employed to spin the impeller at the said single fixed, continuous speed. The diverters described herein can then be used to control the flow through the pump instead of varying the speed of the pump. If a low cost brushed motor is employed, the need for a higher cost variable speed brushless BLDC electric motor, and all of the more expensive and sophisticated commutation electronics, software and hardware required to drive it, in order to provide multiple speed control, can be avoided.

With the DC motor running at one continuous speed, the diverters as proposed herein would then be employed to direct flow to various points within the system, by reducing or redirecting the flow. As required, the DC motor could still be stopped or pulsed on and off, slowly or rapidly (i.e. PWM pulse width modulation) as well, say for initial cold engine starting.

Figure 20:
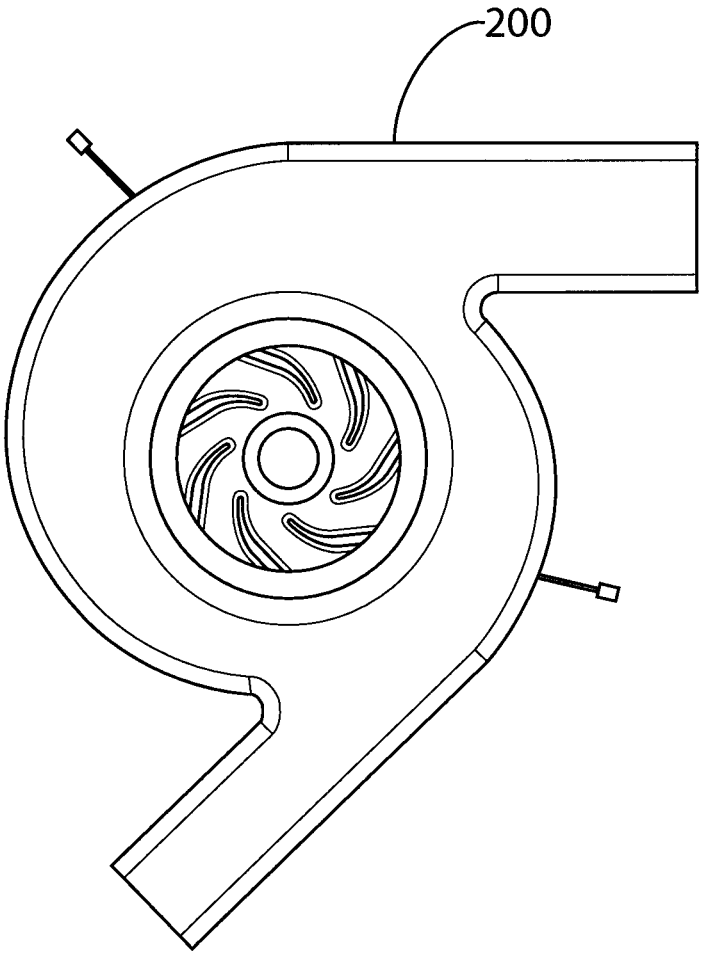
FIG. 20 is a pump driven by one or two possible electric motors.
Figure 20:
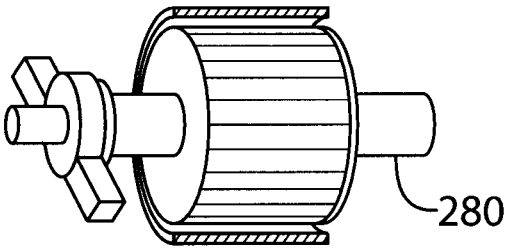
Figure 20:
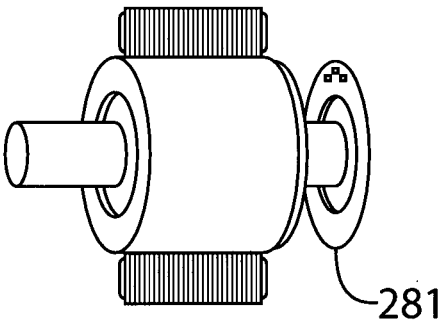
Figure 21:
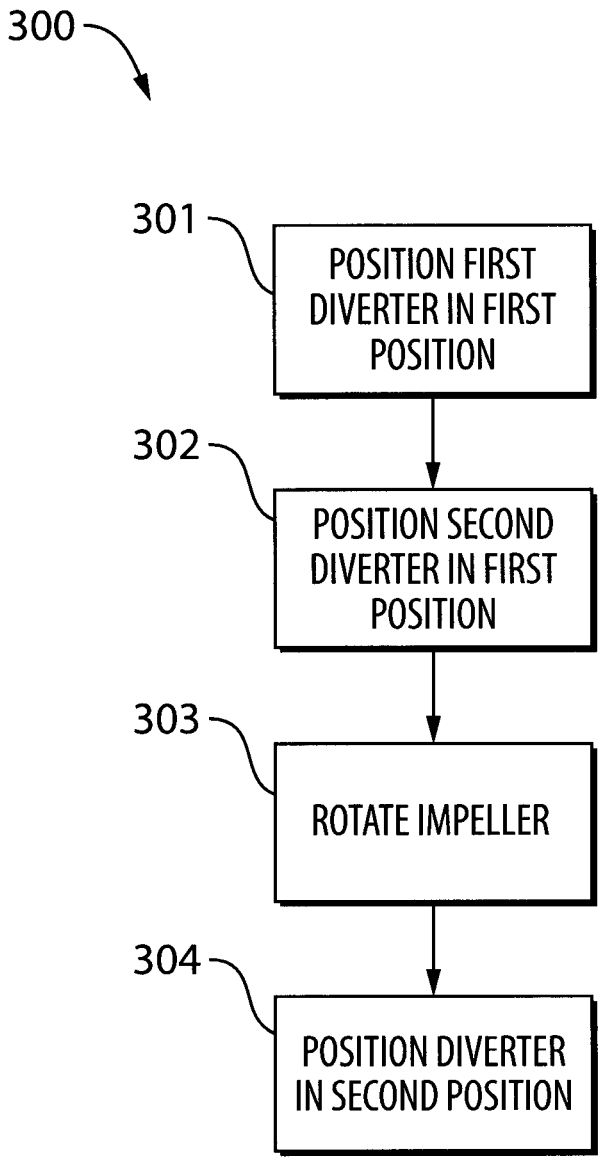
FIG. 21 is a flow diagram relating to the operation of the pump shown in FIG. 17.

Optionally usable electric motors as described above are shown in FIG. 20 at 280 and 281 and may be coupled directly to the shaft 18 of the water pump 20 or 200, or may be coupled indirectly via transmission elements such as gears.

Reference is made to FIG. 11, which shows a flow diagram of a method 300 of operating a pump. Reference numbers relating to the pump 200 are used as an example here however it will be understood that the pump operated by the method could be something other than the pump 200. In relation to the example embodiment of the method 300 the pump 200 has a pump housing 204 having a pump inlet 206, a first pump outlet 208 connected to a first cooling load 210 and a second pump outlet 212 connected to a second cooling load 214 and that has an impeller 216 rotatably supported in the pump housing 204 for rotation about an impeller axis A. The impeller 216 has an impeller inlet 218 configured for drawing in liquid from the pump inlet 206 during rotation of the impeller 216, and an impeller outlet 220 configured for discharging liquid in a generally radial direction. The pump housing 204 has a first impeller outlet receiving chamber 221*a* for transport of liquid from the impeller 216 to the first pump outlet 208 and a second impeller outlet receiving chamber 221*b* for transport of liquid from the impeller 216 to the second pump outlet 212. The method includes step 301, which includes positioning a first cooling load diverter 222 in the pump housing 204 in a first position for the first cooling load diverter in the first impeller outlet receiving chamber 221*a*. In the first position the diverter 222 forms at least part of a first volute around a first portion of the impeller 216. The method further includes step 302 which includes positioning a second cooling load diverter in the pump housing in a first position for the second cooling load diverter in the second impeller outlet receiving chamber 221*b*. In the first position for the second cooling load diverter the second cooling load diverter forms at least part of a second volute around a second portion of the impeller. The method further includes step 303 which includes rotating the impeller at a selected speed after steps 301 and 302 to cause a first flow rate through the first pump outlet 208 and a first flow rate through the second pump outlet 212. The method further includes step 304 which includes positioning the first cooling load diverter in a second position for the first cooling load diverter 222 while maintaining the impeller at the selected speed and while maintaining the second cooling load diverter 224 in the first position, and thereby causing a second flow rate through the first pump outlet 208 that is smaller than the first engine block flow rate, while substantially maintaining the first flow rate through the second pump outlet 212.

While the above description constitutes a plurality of embodiments of the present invention, it will be appreciated that the present invention is susceptible to further modification and change without departing from the fair meaning of the accompanying claims.

The invention claimed is:

1. A pump for pumping liquid through a vehicular cooling system, comprising:

a pump housing having a pump inlet, a first pump outlet fluidically connected to a first cooling load and a second pump outlet fluidically connected to a second cooling load;

an impeller rotatably supported in the pump housing, and having an axially oriented impeller inlet configured for drawing in liquid generally axially from the pump inlet during rotation of the impeller, and a radially oriented impeller outlet configured for discharging liquid generally radially from the impeller towards the first and second pump outlets;

a first cooling load diverter having a first end and an opposing second end, the first end of the first cooling load diverter being pivotally connected to the pump housing;

a second cooling load diverter having a first end and an opposing second end, the first end of the second cooling load diverter being pivotally connected to the pump housing;

wherein the first cooling load diverter is movable between a first position for the first cooling load diverter in which the first cooling load diverter provides a first flow restriction to flow out from the first pump outlet and a second position for the first cooling load diverter in which the first cooling load diverter provides a second flow restriction to flow out from the first pump outlet that is greater than the first flow restriction to flow out from the first pump outlet, wherein, in the first position for the first cooling load diverter, the first cooling load diverter forms at least a portion of a first volute around a first portion of the impeller so that the first flow restriction for the first cooling load diverter is zero, wherein the second cooling load diverter is movable between a first position for the second cooling load diverter in which the second cooling load diverter provides a first flow restriction to flow out from the second pump outlet, and a second position for the second cooling load diverter in which the second cooling load diverter provides a second flow restriction to flow out from the second pump outlet that is greater than the first flow restriction to flow out from the second pump outlet, wherein, in the first position for the second cooling load diverter, the second cooling load diverter forms at least a portion of a second volute around a second portion of the impeller so that the first flow restriction for the second cooling load diverter is zero, wherein the first volute increases progressively in cross-sectional area in a direction from the first end of the first diverter to the second end of the first diverter, wherein the second volute increases progressively in cross-sectional area in a direction from the first end of the second diverter to the second end of the second diverter;

a first actuator operatively connected to the first cooling load diverter for selectively moving the first cooling load diverter between the first and second positions for the first cooling load diverter; and a second actuator operatively connected to the second cooling load diverter for selectively moving the second cooling load diverter between the first and second positions for the second cooling load diverter, wherein the first and second actuators are independently controlled to move the first and second cooling load diverters independent of each other.

2. The pump as claimed in claim 1, wherein, over a selected range of engine rpm, movement of the first cooling load diverter between the first and second positions for the first cooling load diverter while maintaining the second cooling load diverter in the first position for the second cooling load diverter causes less than a 10 percent change in liquid flow through the second pump outlet.

3. The pump as claimed in claim 2, wherein the selected range of engine rpm includes an engine rpm of about 1000 rpm.

4. The pump as claimed in claim 1, wherein, over a selected range of engine rpm, movement of the first cooling load diverter between the first and second positions for the first cooling load diverter while maintaining the second cooling load diverter in the first position for the second cooling load diverter causes less than a 5 percent change in liquid flow through the second pump outlet.

5. The pump as claimed in claim 4, wherein the selected range of engine rpm includes an engine rpm of about 2000 rpm.

6. A method of operating a pump that has a pump housing having a pump inlet, a first pump outlet connected to a first cooling load and a second pump outlet connected to a second cooling load and that has an impeller rotatably supported in the pump housing for rotation about an impeller axis, wherein the impeller has an impeller inlet configured for drawing in liquid from the pump inlet during rotation of the impeller, and an impeller outlet configured for discharging liquid in a generally radial direction, wherein the pump housing has a first impeller outlet receiving chamber for transport of liquid from the impeller to the first pump outlet and a second impeller outlet receiving chamber for transport of liquid from the impeller to the second pump outlet, wherein the method comprises:

a) providing a first cooling load diverter in the pump housing in the first impeller outlet receiving chamber, the first cooling load diverter being moveable between a first position in which flow is substantially unrestricted and a second position which substantially prohibits liquid flow through the first pump outlet;

b) providing a second cooling load diverter in the pump housing in the second impeller outlet receiving chamber, the second cooling load diverter being moveable between a first position in which flow is substantially unrestricted and a second position which substantially prohibits liquid flow through the second pump outlet;

c) shaping the first and second cooling load diverters and the first and second first impeller outlet receiving chambers so that, while the impeller is rotating at a selected speed, positioning the first cooling load diverter in the second position for the first cooling load diverter while maintaining the impeller at the selected speed and while maintaining the second cooling load diverter in the first position for the second cooling load diverter does not change a first flow rate through the second pump outlet by more than 10%.

7. The method as claimed in claim 6, wherein the impeller speed is 1000 rpm and positioning the first cooling load diverter in its second position while maintaining the second cooling load diverter in its first position causes less than a 10 percent change in liquid flow through the second pump outlet.

8. The method as claimed in claim 6, wherein the impeller speed is 2000 rpm and positioning the first cooling load diverter in its second position while maintaining the second cooling load diverter in its first position causes less than a 5 percent change in liquid flow through the second pump outlet.

9. A pump for pumping liquid through a vehicular cooling system, comprising:

a pump housing having a pump inlet, a first pump outlet fluidically connected to a first cooling load and a second pump outlet fluidically connected to a second cooling load;

an impeller rotatably supported in the pump housing, and having an axially oriented impeller inlet configured for drawing in liquid generally axially from the pump inlet during rotation of the impeller, and a radially oriented impeller outlet configured for discharging liquid generally radially from the impeller towards the first and second pump outlets; and a first cooling load diverter connected to the pump housing and a second cooling load diverter connected to the pump housing, wherein the first cooling load diverter is movable between a first position for the first cooling load diverter in which the first cooling load diverter provides a first flow restriction to flow out from the first pump outlet and a second position for the first cooling load diverter in which the first cooling load diverter provides a second flow restriction to flow out from the first pump outlet that is greater than the first flow restriction to flow out from the first pump outlet, wherein the second cooling load diverter is movable between a first position for the second cooling load diverter in which the second cooling load diverter provides a first flow restriction to flow out from the second pump outlet, and a second position for the second cooling load diverter in which the second cooling load diverter provides a second flow restriction to flow out from the second pump outlet that is greater than the first flow restriction to flow out from the second pump outlet, a first actuator operatively connected to the first cooling load diverter for selectively moving the first cooling load diverter between the first and second positions for the first cooling load diverter, and a second actuator operatively connected to the second cooling load diverter for selectively moving the second cooling load diverter between the first and second positions for the second cooling load diverter, wherein the first and second actuators are independently controlled to move the first and second cooling load diverters independent of each other, wherein, over a selected range of engine rpm, movement of the first cooling load diverter between the first and second positions for the first cooling load diverter while maintaining the second cooling load diverter in the first position for the second cooling load diverter causes less than a 10 percent change in liquid flow through the second pump outlet, wherein in the first position for the first cooling load diverter, the first cooling load diverter is at least twice as open as in the second position for the first cooling load diverter.

10. The pump as claimed in claim 9, wherein, in the second position for the first cooling load diverter, the first cooling load diverter is at least 5% open.

11. The pump as claimed in claim 9, wherein, in the second position for the first cooling load diverter, the first cooling load diverter is at least 10% open.

* * * * *